US012521610B2

(12) United States Patent
Brekke

(10) Patent No.: US 12,521,610 B2
(45) Date of Patent: Jan. 13, 2026

(54) GOLF CLUB HEAD

(71) Applicant: SUMITOMO RUBBER INDUSTRIES, LTD., Kobe (JP)

(72) Inventor: Dustin Brekke, Fountain Valley, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 18/219,436

(22) Filed: Jul. 7, 2023

(65) Prior Publication Data

US 2024/0033588 A1 Feb. 1, 2024

Related U.S. Application Data

(60) Provisional application No. 63/370,078, filed on Aug. 1, 2022.

(51) Int. Cl.
*A63B 53/04* (2015.01)
*A63B 53/00* (2015.01)

(52) U.S. Cl.
CPC ..... *A63B 53/047* (2013.01); *A63B 53/005* (2020.08); *A63B 53/0408* (2020.08); *A63B 2053/0479* (2013.01)

(58) Field of Classification Search
CPC ..... A63B 53/0408; A63B 53/047; A63B 53/0475; A63B 2053/0479; A63B 2053/0483
See application file for complete search history.

(56) References Cited

U.S. PATENT DOCUMENTS

| | | | | |
|---|---|---|---|---|
| 10,376,755 | B2 * | 8/2019 | Ripp | A63B 53/04 |
| 10,561,909 | B2 * | 2/2020 | Ripp | A63B 53/047 |
| 10,632,352 | B2 * | 4/2020 | Lambeth | A63B 53/0487 |
| 10,661,129 | B2 * | 5/2020 | Seagram | A63B 60/00 |
| 10,682,555 | B2 * | 6/2020 | Ripp | A63B 53/047 |
| 10,843,052 | B2 * | 11/2020 | Seagram | A63B 53/047 |
| 11,130,023 | B1 * | 9/2021 | Brekke | A63B 53/02 |
| 11,247,107 | B2 * | 2/2022 | Seagram | A63B 53/047 |
| 11,786,787 | B2 * | 10/2023 | Ripp | A63B 53/047 473/324 |
| 2019/0224536 | A1 * | 7/2019 | Shimahara | A63B 53/047 |
| 2020/0289901 | A1 * | 9/2020 | Ripp | A63B 53/047 |
| 2021/0283471 | A1 * | 9/2021 | Ripp | A63B 53/047 |
| 2022/0370864 | A1 * | 11/2022 | Lambeth | A63B 53/047 |

* cited by examiner

*Primary Examiner* — Alvin A Hunter
(74) *Attorney, Agent, or Firm* — Oliff PLC

(57) ABSTRACT

A golf club head includes a striking face having a face center and defining a face plane, a virtual vertical center plane perpendicular to the face plane and passing through the face center, a sole portion, a top portion, a heel portion, a toe portion, a hosel configured to receive a shaft, and a loft, L, no less than 39°. A center of gravity is spaced from the vertical center plane by a distance, D7. A moment of inertia, Iyy, is measured about an axis extending in a heel to toe direction, parallel with a ground plane, and passes through the center of gravity, such that Iyy/D7≥527.4 g·cm/°×L−23,580 g·cm.

7 Claims, 30 Drawing Sheets

| CLUB HEAD | BOUNCE OPTION | LOFT (°) | INSERT DENSITY (g/cc) | INSERT MASS (g) |
|---|---|---|---|---|
| 500A | 1 | 46 | 2 | 7.34 |
| 500B | 1 | 50 | 2 | 7 |
| 500C | 1 | 54 | 2 | 6.35 |
| 500D | 1 | 58 | 2 | 5.7 |
| 500G | 2 | 54 | 2 | 6.34 |
| 500H | 2 | 58 | 2 | 5.69 |

FIG. 31

| INSERT | DENSITY (g/cc) | MASS (g) | DIAMETER AT TOP (mm) |
|---|---|---|---|
| 190A | 2.0 | 7.34 | 8.55 |
| 190B | 2.0 | 7.0 | 8.55 |
| 190C | 2.0 | 6.35 | 8.55 |
| 190D | 2.0 | 5.7 | 8.55 |
| 190E | 2.0 | 6.34 | 8.55 |
| 190F | 2.0 | 5.69 | 8.55 |

FIG. 32A

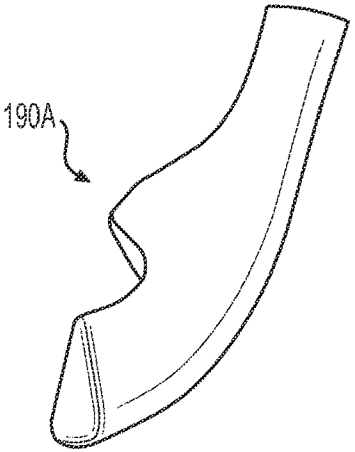
FIG. 32B
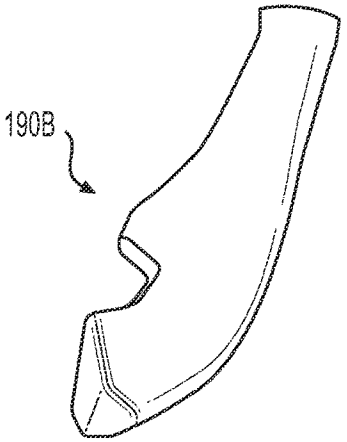
FIG. 32C
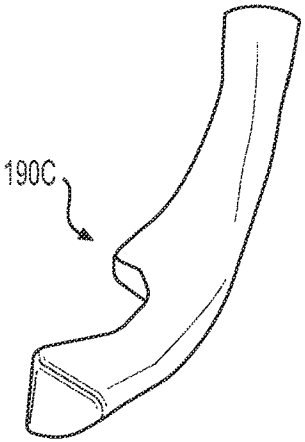
FIG. 32D
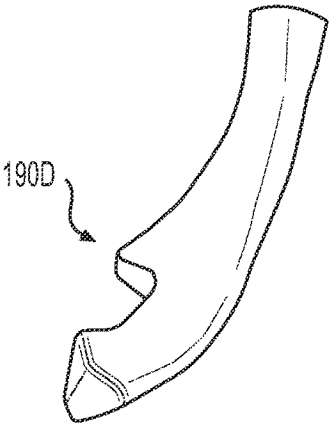
FIG. 32E
FIG. 32F
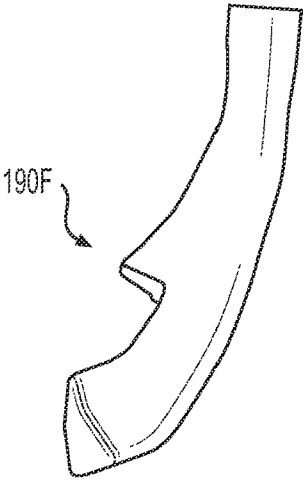
FIG. 32G
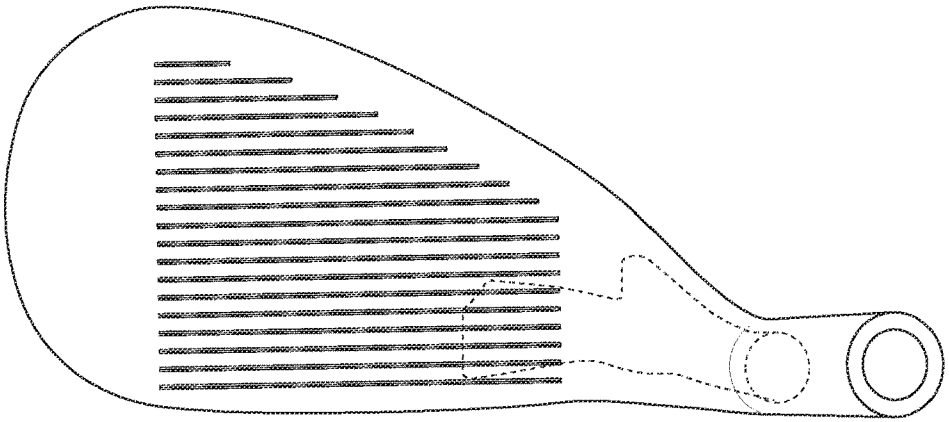
FIG. 32H

| EXEMPLARY CLUB HEAD PARAMETERS | | | | |
|---|---|---|---|---|
| LOFT (DEGREES) | 46.000 | 50.000 | 58.000 | 60.000 |
| Izz (g*cm2) | 2611.000 | 2690.000 | 2994.000 | 3145.000 |
| Iyy (g* cm2) | 921.000 | 962.000 | 1095.000 | 1133.000 |
| D7 (mm) | 2.340 | 1.250 | 0.500 | 0.450 |
| CG HEIGHT (mm) | 21.150 | 20.610 | 20.270 | 19.380 |
| D5 (mm) | 1.220 | 1.000 | 0.273 | 0.135 |
| Izz/D7 | 393.590 | 769.600 | 2190.000 | 2517.778 |

FROM FIG 37B

GOLF CLUB HEAD

BACKGROUND

This disclosure relates generally to the field of golf clubs. More particularly, it relates to a golf club head with an insert in at least the hosel portion of the club head.

A goal of golf club head design is to align the club head's center of gravity with the location on the striking face most likely to come into contact with the golf ball during a swing. This increases shot accuracy and helps ensure that as much energy as possible from the golfer's swing is transferred to the golf ball at impact, thereby resulting in a favorable golf shot.

SUMMARY

But this goal can often be difficult to achieve within the constraints of a given mass budget. This is especially true in connection with "player" iron-type golf club heads, in which the center of gravity of the club head is naturally biased toward the heel side from face center due to the shaping and weight of the heel and hosel portions. Golfers who use these club heads also often enjoy their more traditional look, and these golfers may thus object to changes designed to beneficially alter the weight profile of the club head but that also cause the club head to diverge from this traditional look. For example, perimeter weighting may be added to an iron or wedge-type golf club head to increase its moments of inertia and thereby add "forgiveness" on off-center hits, but the appearance of such a cavity-back club head can be off-putting for players who prefer the appearance of blade-type irons and wedges. Such features also may deleteriously affect sweet spot location, particularly in the case of wedge-type golf club heads, in which backspin characteristics are relevant. A need thus exists for a design that discretely moves weight from one portion of the club head to another so as to move the center of gravity closer to where the golf ball is likely to be struck, while also providing forgiveness on off-center hits.

A golf club head according to one or more aspects of the present disclosure includes, when oriented in a reference position, a striking face having a face center and defining a face plane; a virtual vertical center plane perpendicular to the face plane and passing through the face center; a sole portion; a top portion opposite the sole portion; a heel portion; a toe portion opposite the heel portion; a hosel configured to receive a shaft and defining a hosel axis; a loft, L, no less than 39°; a center of gravity spaced from the vertical center plane by a distance, D7; and a moment of inertia, Iyy, measured about an axis extending in a heel to toe direction, parallel with the virtual ground plane, and passing through the center of gravity, wherein: $Iyy/D7 \geq 527.4\ g\cdot cm/° \times L - 23{,}580\ g\cdot cm$.

A golf club head according to one or more aspects of the present disclosure includes, when oriented in a reference position, a striking face having a face center and defining a face plane; a virtual vertical center plane perpendicular to the face plane and passing through the face center; a sole portion; a top portion; a heel portion; a toe portion opposite the heel portion; a hosel configured to receive a shaft and defining a hosel axis; a loft, L, no less than 39°; a center of gravity spaced from the vertical center plane by a distance, D7, wherein: $D7 \leq 10.1\ mm - 0.135\ mm/° \times L$; and a moment of inertia, Iyy, measured about an axis extending in a heel to toe direction, parallel with the virtual ground plane, and passing through the center of gravity, wherein: $Iyy \geq 16.63\ g\cdot cm^2/° \times L + 114\ g\cdot cm^2$.

A golf club head according to one or more aspects of the present disclosure includes, when oriented in a reference position, a main body including: a top portion; a sole portion opposite the top portion; a heel portion; a toe portion opposite the heel portion; a hosel portion extending from the heel portion and comprising a hosel bore with an open end for receiving a shaft and a bottom surface opposite the open end; and a striking face defining a virtual face plane and having a face center, wherein the main body is formed of a first material having a first melting point and a first density; a virtual vertical plane perpendicular to the virtual face plane and extending through the face center; an auxiliary component comprising a component mass, Ma, no less than 5.5 g, the auxiliary component formed of a second material having a second melting point greater than the first melting point and a second density less than the first density, the auxiliary component located at least in part within the hosel portion and at least partially encapsulated by the first material; and a center of gravity spaced no more than 5 mm from the virtual vertical plane.

A golf club head according to one or more aspects of the present disclosure includes: a sole portion; a top portion opposite the sole portion; a heel portion; a toe portion opposite the heel portion; a hosel configured to receive a shaft; and a striking face comprising a face center, defining a virtual striking face plane, and having a base surface and a plurality of scorelines recessed from the base surface, a portion of the base surface having an average surface roughness, Ra, no greater than 180 μin, a developed interfacial area ratio, Sdr, of no less than 3%, and a reduced peak height to core ratio, Spk/Sk, of no greater than 2.

A golf club head according to one or more aspects of the present disclosure includes, when oriented in a reference position, a sole portion; a top portion opposite the sole portion; a heel portion; a toe portion opposite the heel portion; a hosel configured to receive a shaft; a striking face comprising a face center, defining a virtual striking face plane, and having a base surface and a plurality of scorelines recessed from the base surface, a portion of the base surface having an average surface roughness, Ra, no greater than 180 μin, a developed interfacial area ratio, Sdr, of no less than 1%, and a reduced peak height to core ratio, Spk/Sk, of no greater than 2; a virtual vertical plane perpendicular to the striking face plane and passing through the face center; and a center of gravity spaced from the virtual vertical plane by a distance, D7, no greater than 2.5 mm.

A correlated set of golf club heads according to one or more aspects of the present disclosure includes, when oriented in a reference position, a first golf club head comprising a first loft and a first striking face comprising a first base surface, including a first base surface portion, and a first plurality of scorelines recessed from the first base surface, the first base surface portion having a first average surface roughness, Ra1, no greater than 180 μin, a first reduced peak height to core ratio, Spk/Sk1, no greater than 2, and a first developed interfacial area ratio, Sdr1, no less than 1%; and a second golf club head comprising a second loft different from the first loft and a second striking face comprising a second base surface, including a second base surface portion, and a second plurality of scorelines recessed from the second base surface, the second base surface portion having a second average surface roughness, Ra2, no greater than 180 μin, a second reduced peak height to core ratio, Spk/

Sk2, no greater than 2, and a second developed interfacial area ratio, Sdr2, such that a difference between Sdr2 and Sdr1 is no less than 0.75%.

These and other features and advantages of the golf club heads and manufacturing methods thereof according to the various aspects of the present disclosure will become more apparent upon consideration of the following description, drawings, and appended claims. The description and drawings described below are for illustrative purposes only and are not intended to limit the scope of the present invention in any manner.

BRIEF DESCRIPTION OF THE DRAWINGS

FIG. 31 shows properties of golf club heads of Bounce Options #1 and #2.

FIGS. 32A-32H show properties and shapes of low-density inserts for a golf club head.

DETAILED DESCRIPTION OF EMBODIMENTS

Figure 1:
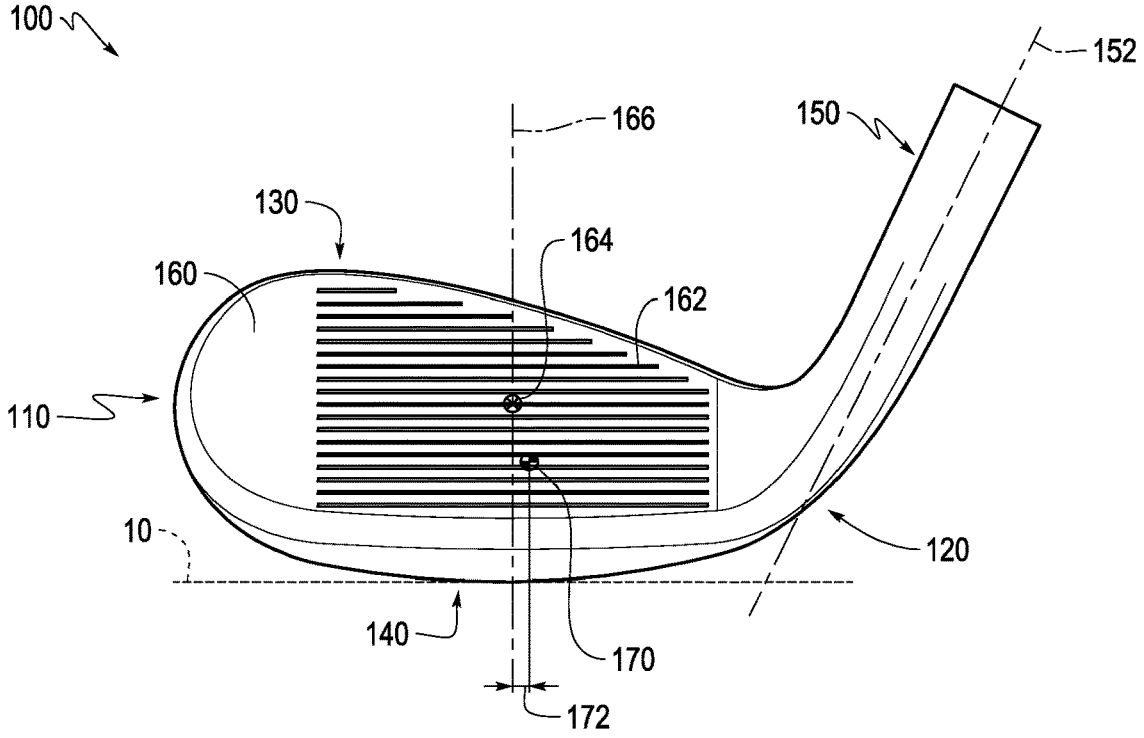
FIG. 1 shows a front elevation view of an exemplary golf club head in accordance with one or more aspects of the present disclosure.
Figure 2:
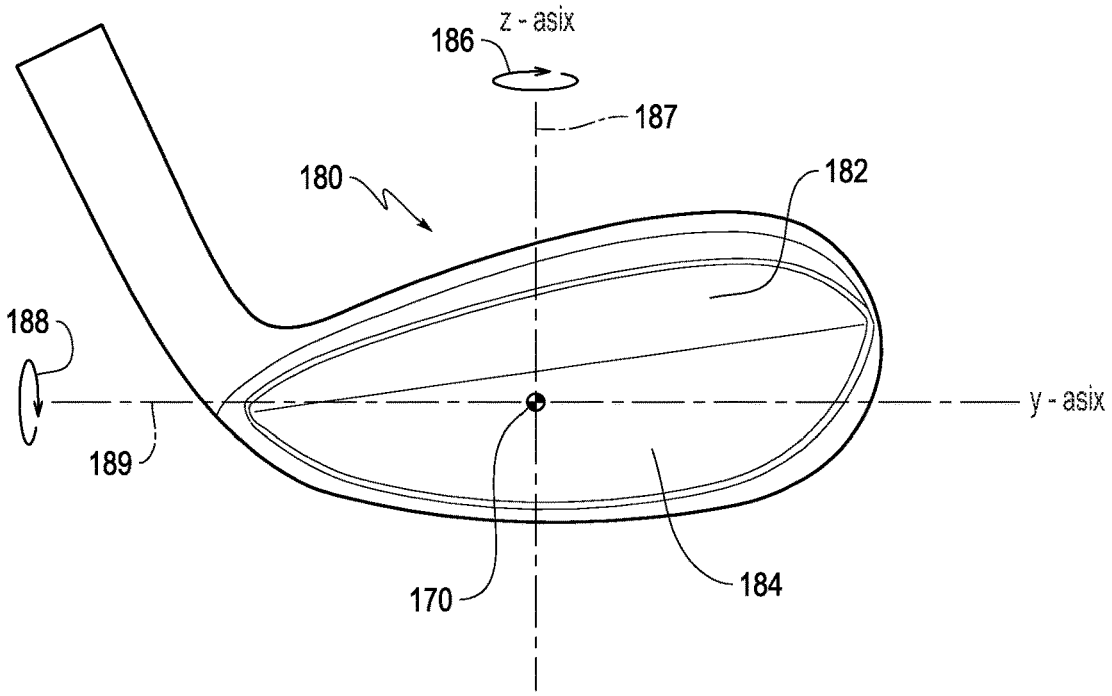
FIG. 2 shows a rear schematic view of the exemplary golf club head of FIG. 1.

Shown in FIGS. 1 and 2 is a golf club head 100 in accordance with one or more aspects of the present disclosure. A main body of this golf club head may be bounded by a toe portion 110, a heel portion 120 opposite the toe portion, a top portion 130, and a sole portion 140 opposite the top portion. A hosel portion 150 for securing the club head to an associated shaft (not shown) may extend from the heel portion, and the hosel portion may in turn define a virtual central hosel axis 152.

The club head may further include a striking face 160 at a front portion thereof. The striking face is the substantially planar exterior surface part of the front portion that generally conforms to a virtual striking face plane 76 and that is arranged to contact a golf ball at a factory-designated loft angle taken between the striking face plane 76 and the central hosel axis 152. The striking face may be formed with surface features that increase traction between the striking face and a struck golf ball to ensure both good contact with the ball (for example, in wet conditions) and impart a degree of spin to the ball, e.g., for stability in flight or to control better the rest position of a struck golf ball once it has returned to the ground by way of backspin. A plurality of substantially parallel horizontal grooves or score lines 162 may be recessed from the striking face. Various features of low scale may be considered to form a texture pattern on the striking face.

The striking face may include a leading edge 161 constituting the junction formed between the generally planar striking face 160 and the sole portion 140. The leading edge 161 includes a forwardmost point 165 (see FIGS. 1 and 3). A virtual vertical center plane 166 passes through the forwardmost point 165 of the leading edge 161. The striking face may include a face center 164. Face center, as used herein, refers to the point on the striking face of the club head that is halfway between the topmost extent and sole-most extent of the score lines and that passes through the virtual center plane 166. In some embodiments, for example the embodiment shown in FIG. 1, the face center is preferably also located halfway between a heel-most extent and a toe-most extent of the scorelines. However, in alternative embodiments, the face center is not located halfway between the heel-most extent and the toe-most extent of the scorelines. For example, the scorelines may be laterally offset from the leading edge contour or the scorelines may fully extend into the toe portion of the striking face. A virtual vertical center plane 166 perpendicular to the face plane may project through the face center in the front-to-rear direction of the club head, and a center of gravity 170 of the golf club head may be spaced from that virtual vertical center plane. In FIG. 1, for example, the center of gravity may be spaced heelward from the virtual vertical center plane. The center of gravity may be spaced by a distance 172 less than 5 mm from the virtual vertical center plane, and in more preferred embodiments, it may be spaced less than 2.5 mm from that virtual vertical center plane.

The golf club head is shown in FIG. 1 as being in the "reference position." As used herein, "reference position" denotes a position of a golf club head, e.g., the club head of FIG. 1, in which the sole portion of the club head contacts a virtual ground plane 10 such that the virtual central hosel axis 152 of the hosel portion lies in a virtual vertical hosel plane and the score lines 162 are oriented horizontally relative to the ground plane 10. Unless otherwise specified, all club head dimensions described herein are taken with the club head in the reference position.

The golf dub head of FIGS. 1 and 2 preferably comprises an iron-type dub head such as a wedge-type dub head, and it may preferably have a loft angle of no less than 39°. More preferably, the golf dub head may be a traditional blade-type dub head, which may otherwise be referred to as a "player"-type dub head by certain golfers. As such, and as shown in FIG. 2, a rear 180 of the dub head may include an upper blade portion 182 and a lower muscle portion 184. The upper bade portion may preferably comprise a substantially planar surface, and it may thus preferably lack any substantial perimeter-weighting features. The muscle portion may project rearward from the upper blade portion in a direction perpendicular to the plane of the striking face. Mass of the golf dub head may be generally concentrated in the muscle portion, so the center of gravity 170 may be located soleward of the face center. And as shown in FIG. 2 specifically, moment of inertia ("MOI") Izz 186 of the golf club head may be measured about a virtual vertical axis 187 passing through the center of gravity, and MOI Iyy 188 of the golf club head may be measured about a virtual horizontal axis 189, parallel to the virtual ground plane, extending in a heel to toe direction, and likewise passes through the center of gravity. As known to those of ordinary skill in the art, MOI is generally correlated with increasing the club head's natural resistance to rotation about a certain axis on off-centered golf ball impacts.

The golf club head of one or more aspects of this disclosure preferably has an internal structure that, compared to other "player"-type golf club heads, discretely moves weight from the heel portion or lower hosel portion to the sole/muscle portion or to the top of the hosel portion, thereby moving the center of gravity closer to the face center, i.e., where experienced golfers are more likely to hit the golf ball on the striking face, and correspondingly increasing both vertical (Izz) and horizontal (Iyy) MOI. Exemplary golf club heads having such an internal structure are described below. Each of these exemplary club heads may include the main body structure described above in connection with FIGS. 1 and 2.

Figure 3:
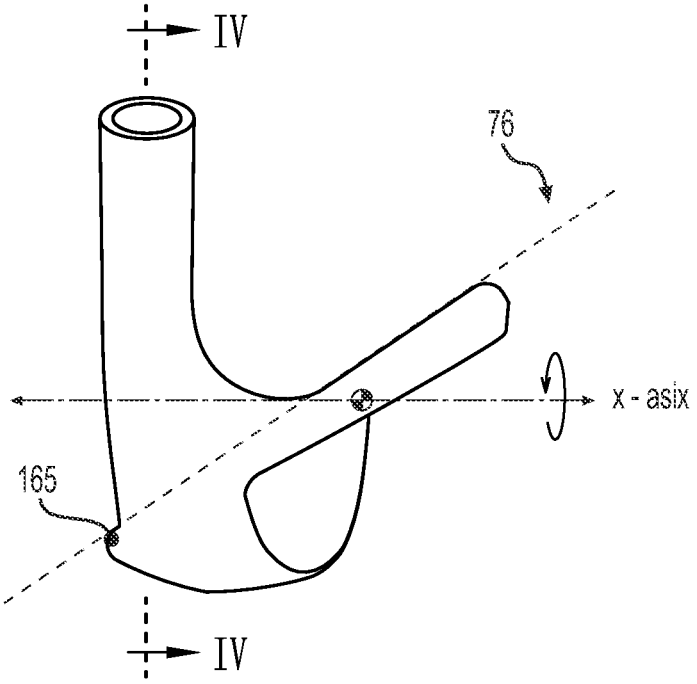
FIG. 3 shows a heel-side elevation view of an exemplary golf club head in accordance with one or more aspects of the present disclosure.
Figure 4:
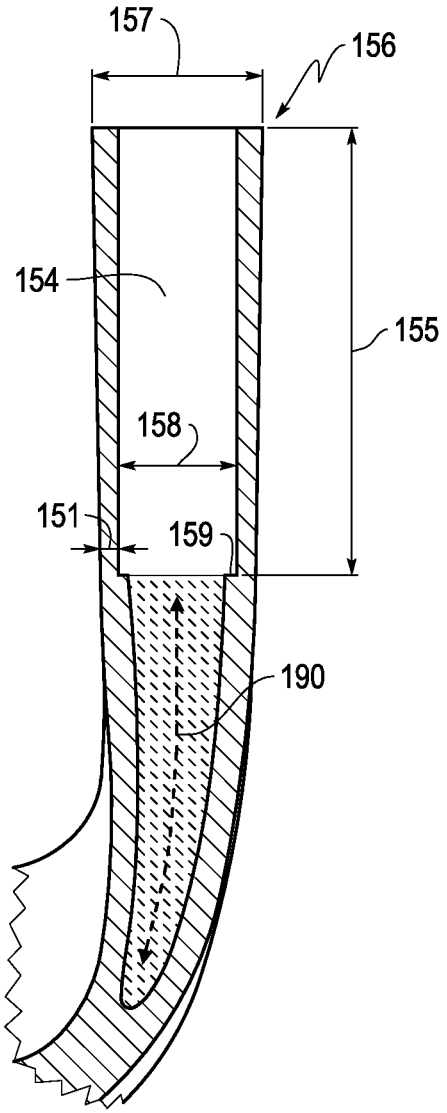
FIG. 4 shows a cross-section of the golf club head of FIG. 3 along the line IV-IV.

FIG. 4 shows a cross-section of a golf club head according to one aspect of the present disclosure taken along line IV-IV in FIG. 3. As shown, the hosel portion 150 of this club head may include a hosel bore 154 extending a depth 155 into the hosel portion from an open, topmost end 156 of the hosel portion. This bore may possess a top inner diameter 157 and a bottom inner diameter 158, which may be the same or may be different. And the hosel bore may terminate at its bottom at a metal shelf 159 that projects inward toward the virtual central hosel axis 152. The hosel portion sidewall (as well as the remainder of the golf club head main body) may constitute a first component preferably formed of a primary material such as steel and/or a material having a density no less than 8 g/cm$^3$ and/or a melting point below 1600° C. And a minimum thickness 151 of the hosel portion sidewall, preferably measured at a bottom of the hosel bore, may be sufficient to ensure structural integrity of the hosel portion without negatively affecting vibrational feedback on golf shots. For example, this minimum thickness may be no less than 0.5 mm, and more preferably no less than 0.75 mm.

Soleward of the bottom of the hosel bore may be an insert 190 that serves as a second, or auxiliary, component (i.e. "auxiliary insert"). The auxiliary insert may include a substantially cylindrical portion 192 (FIG. 8) with a central axis that is coaxial with the virtual central hosel axis 152. The insert may also include a heel portion shaped to generally conform to a heel contour of the golf club head. This insert may be formed of an auxiliary material such as a ceramic, and it may preferably have a melting point higher than that of the first component and a density less than that of the first component. As such, the insert may have a mass less than about 5 g in the golf club head, and relative to the overall mass of the golf club head, the mass of the insert may be less than 1.5%. This insert may by composed of at least 60% aluminum oxide ($Al_2O_3$) by weight. More specifically, this ceramic insert may be composed (by weight) of 20% $SiO_2$, 10% $ZrO_2$, and 70% $Al_2O_3$, although each of these percentages may vary by up to about 10%. By adjusting the ceramic composition, material properties of the insert may be tuned to achieve a weight distribution target, e.g., increased moment of inertia, lower and/or centered center of gravity location, or a particular vibrational frequency upon impact. The insert may also possess the following properties: (i) a bonding strength of 15 MPa; (ii) a porosity of no more than 40%, preferably 30%; (iii) absorption of 30%; (iv) a melting point greater than 2500° C.; and (v) a density preferably no greater than 3 g/cm$^3$, more preferably no greater than 2 g/cm$^3$. But like the composition of the insert, the insert's bonding strength, porosity, absorption, and density may vary to achieve a particular weight distribution target.

Figure 5:
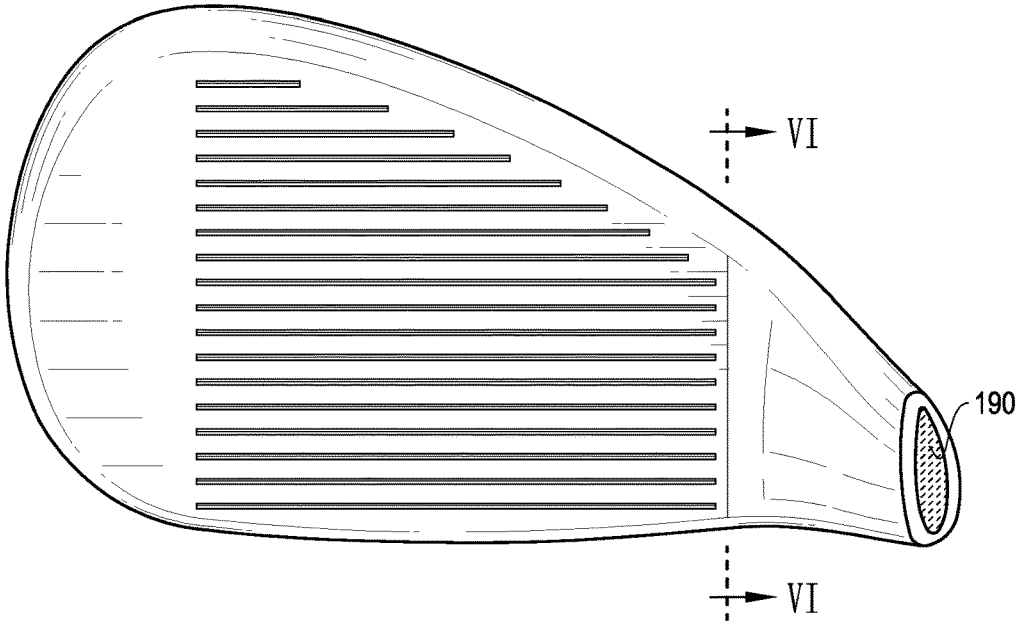
FIG. 5 shows a front perspective view of the golf club head of FIG. 3 with the hosel removed.
Figure 6:
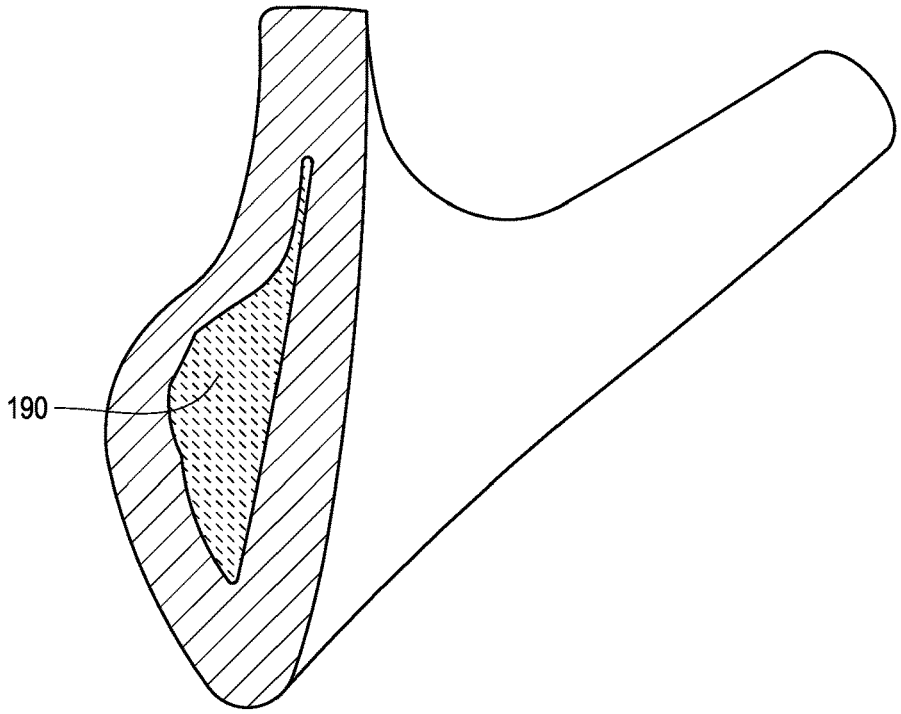
FIG. 6 shows a cross-section of the golf club head of FIG. 5 along the line VI-VI.

As shown in FIG. 6, which shows a cross-section taken at the line VI-VI in FIG. 5, the insert 190 may extend from the hosel portion into the heel portion of the golf club head. And this insert may impact various MOI values of the golf club head. For example, vertical MOI Izz is preferably no less than 2500 g·cm$^2$, more preferably no less than 3,000 g·cm$^2$, and horizontal MOI Iyy may be greater than 1,000 g·cm$^2$.

Figure 7:
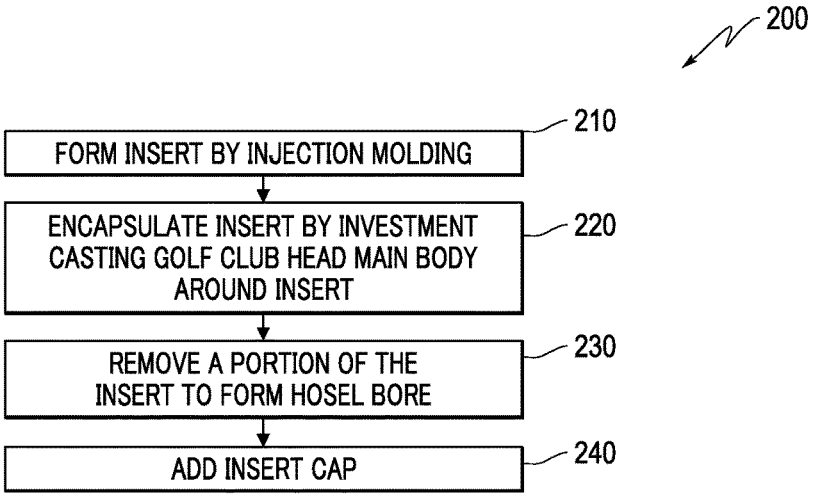
FIG. 7 shows an exemplary method of manufacturing the golf club head of FIG. 3.
Figure 8:
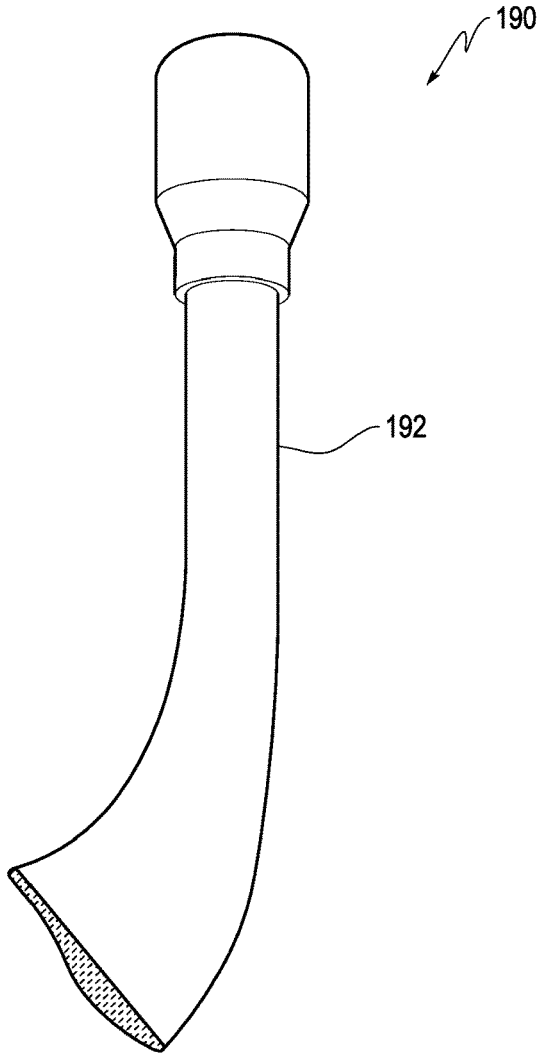
FIG. 8 shows a close-up view of the insert within the golf club head of FIG. 3.
Figure 9:
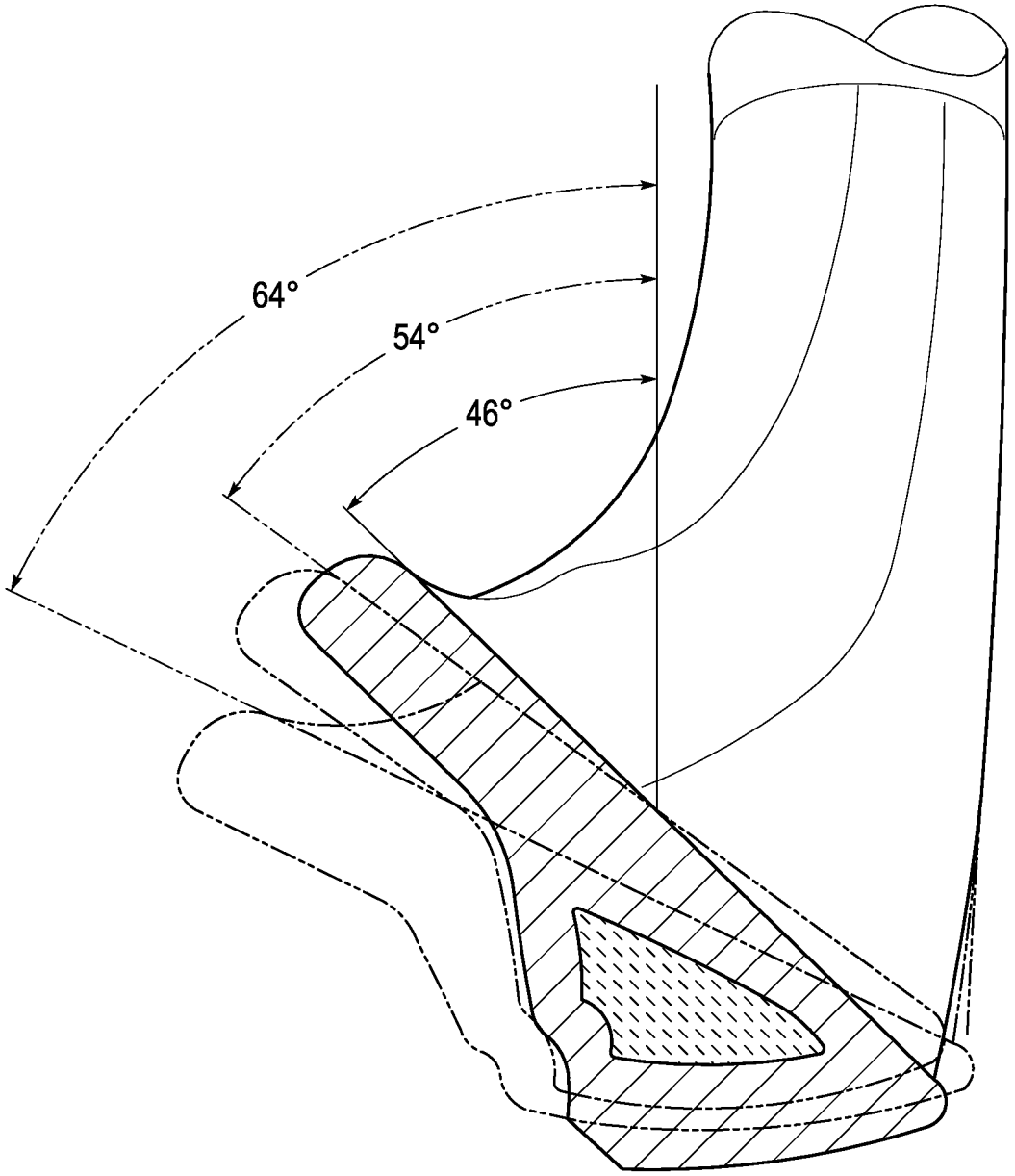
FIG. 9 shows overlapping club heads as part of a method of designing the insert of FIG. 8.

FIGS. 7-12 show an exemplary method 200 of forming the golf club head of FIGS. 3-6. In a first step 210, the insert may be formed by, e.g., injection molding. FIG. 8 shows one embodiment of the insert 190 after this first forming step. This insert may preferably be designed by overlaying various club lofts in a computer-assisted design ("CAD") program and selecting an overlapping region of those club heads while accounting for necessary constraints such as minimal steel wall thickness for integrity of the hosel and/or heel portions. For example, FIG. 9 shows an insert formed in an overlapping area of club heads having lofts of 46°, 54°, and 64°. This design process may ease manufacturing concerns and provide various cost benefits since a new insert is not required to be designed for each golf club head loft and sole shape. In one or more embodiments, a minimum steel wall thickness is no less than 0.5 mm and more preferably no less than 0.75 mm.

Figure 10:
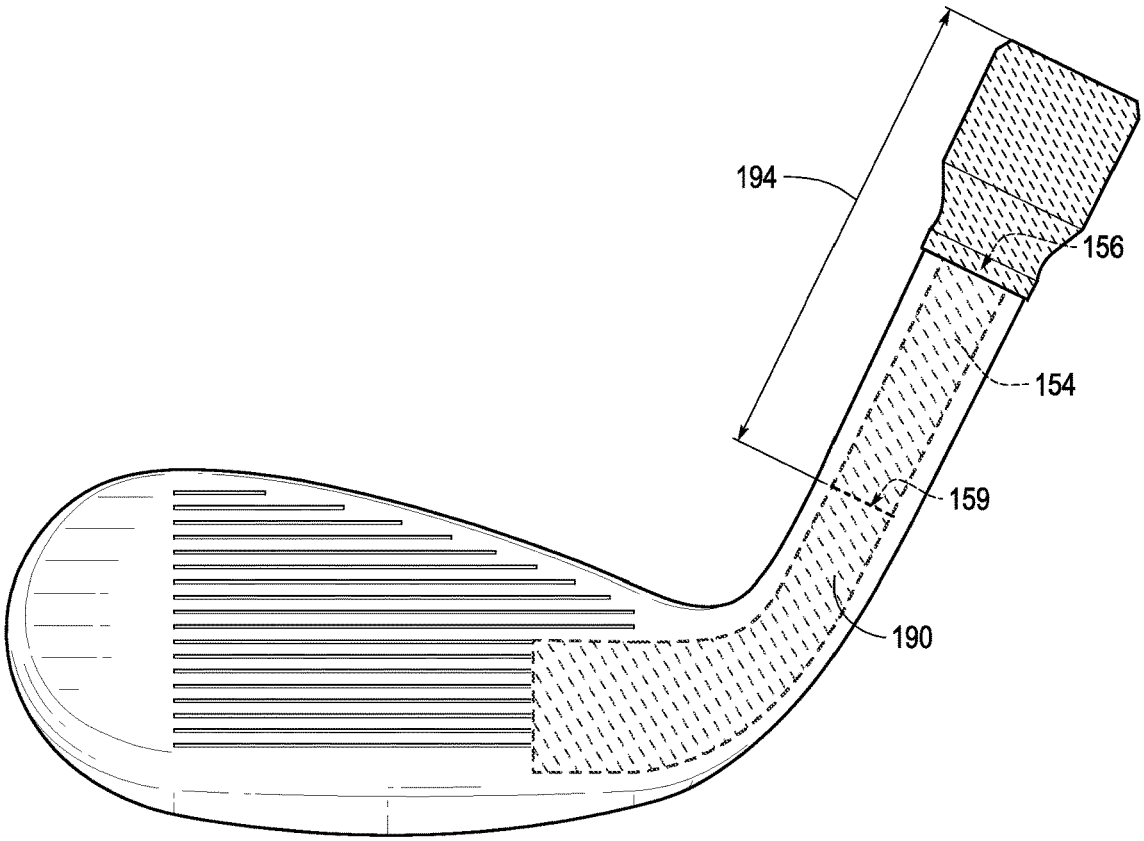
FIG. 10 shows a golf club head resulting from a second step of the method of FIG. 7.
Figure 11:
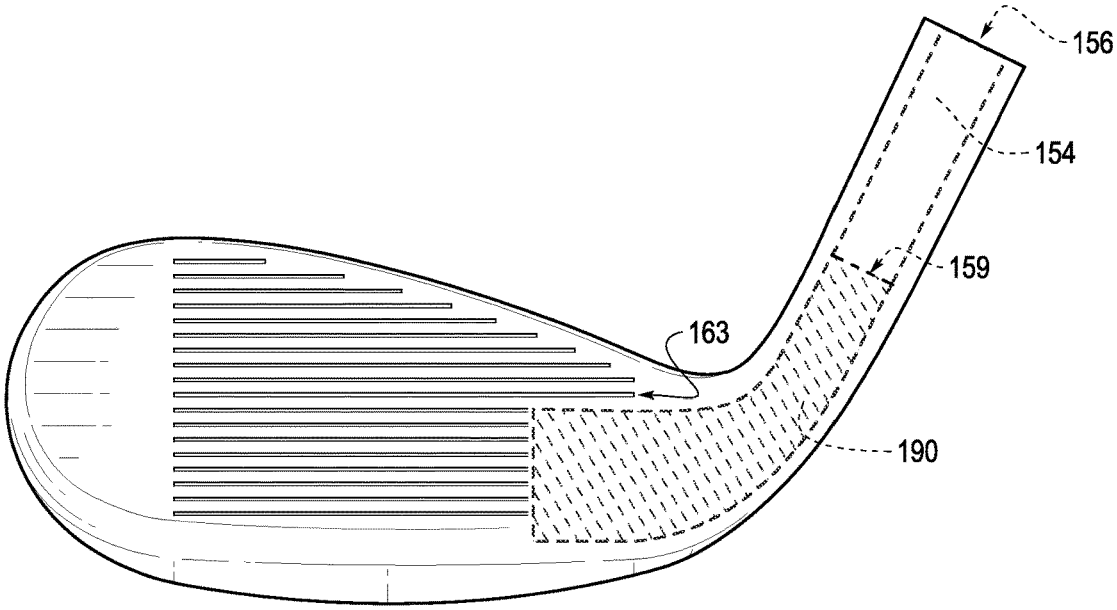
FIG. 11 shows a golf club head resulting from a third step of the method of FIG. 7.

In the second step 220 shown in FIG. 7, the golf club head main body may then be formed, e.g., by investment casting, around the insert 190 so to at least partially, and preferably substantially fully, encapsulate the insert therein. The result of this step is shown in FIG. 10, in which the insert is shown to extend not only below the bottom metal shelf 159 of the hosel bore but also through the hosel bore and beyond the opening at the topmost end 156 of the hosel portion 150. The upper part 194 of the insert, i.e., the portions extending beyond the topmost opening of the hosel portion and extending into the hosel bore, may then be removed in the third step 230 shown in FIG. 7 by, e.g., machining. As shown in FIG. 11, which shows the result of this third step, the hosel bore 154 and topmost end 156 of the hosel portion may now be open so as to be able to receive a golf club shaft, and the insert 190 may extend soleward of the metal shelf 159 delimiting the bottom of the hosel bore.

As also shown in FIG. 11, the insert extends toeward of the heelwardmost extend of the scorelines. Preferably, the insert extends toeward of the heelwardmost extent by at least 1 mm, more preferably at least 2 mm and even more preferably at least 3 mm. Accordingly, discretionary mass is increased and relocated to portions of the club head more suitable to achieve a desirable combination of mass properties, e.g. location of the club head center of gravity (e.g. center of gravity height, center of gravity depth from striking face, and center of gravity lateral spacing from the face center) and moment of inertia, particularly Iyy. Greater extension of the auxiliary insert into this central region, in itself, may result in a lateral shift in center of gravity toe-ward, countering the natural tendency of the center of gravity to be located heelward due to the traditional shape of blade-like iron-type, e.g. wedge-type, club heads. Furthermore, greater extension of the auxiliary insert toe-ward implies a greater insert volume and insert mass, as described further below. As the auxiliary insert preferably bears a lower density than the density of the main body, discretionary mass is increased, thereby enabling greater increases in moment of inertia, e.g. Izz and Iyy by selective re-positioning of such discretionary mass. It has been discovered that an auxiliary insert as constructed in the manner described herein, may extend in the manner described without detrimental effect to performance, including shot dispersion, feel and acoustical considerations upon impact. Further, preferably, in embodiments in which such golf club head is provided in a correlated set of club heads, extension of the auxiliary insert toeward of the heelwardmost extent of the plurality of scorelines varies from club head to club head within the set, as a function of loft. For example, the shaping and mass of lower lofted golf club heads may permit auxiliary inserts of larger mass, thus volume.

Figure 12:
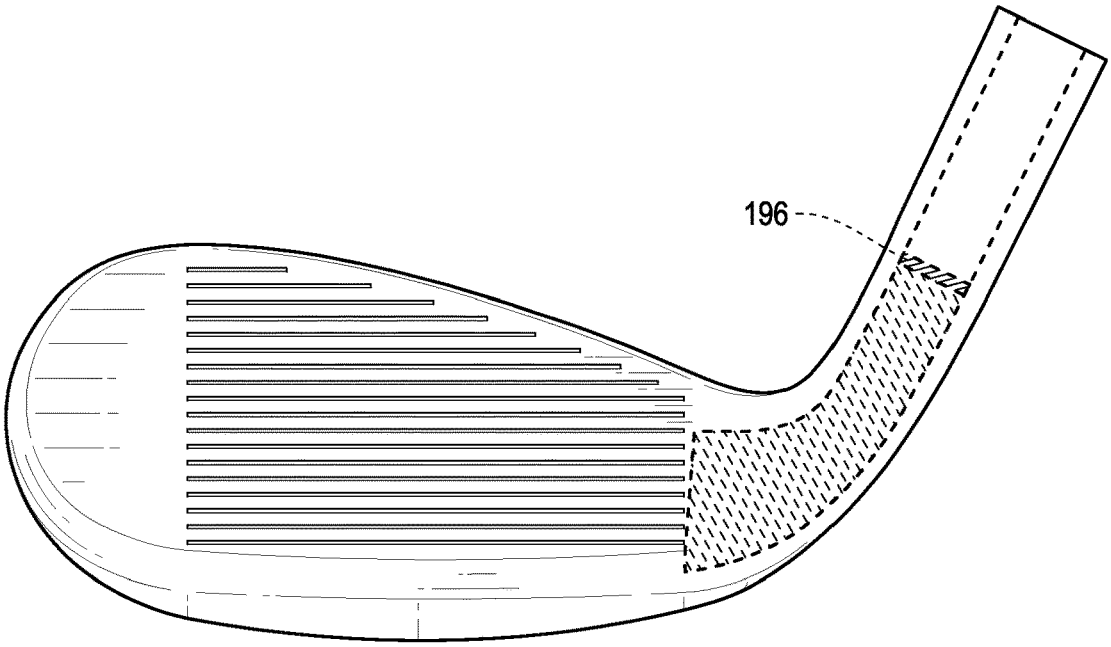
FIG. 12 shows a golf club head resulting from a fourth step of the method of FIG. 7.

And in the final step 240 of FIG. 7, the result of which is shown in FIG. 12, an insert cap 196 may be introduced into the hosel bore to rest on the metal shelf 159. This insert cap, which may be formed of aluminum or ABS plastic, may provide a protective barrier between a tip end of the shaft and the topmost end of the insert. In other embodiments, the insert cap may not be necessary, as the topmost end of the insert is covered by an epoxy layer when the tip end of the shaft is affixed in the hosel bore. By thus forming the main body of the golf club head around the insert, space that would otherwise be filled by denser metallic material is instead occupied by, e.g., a ceramic material. Mass is thus selectively removed from the hosel and heel portions, thereby accomplishing the goal of moving the center of gravity closer to the face center.

Figure 13:
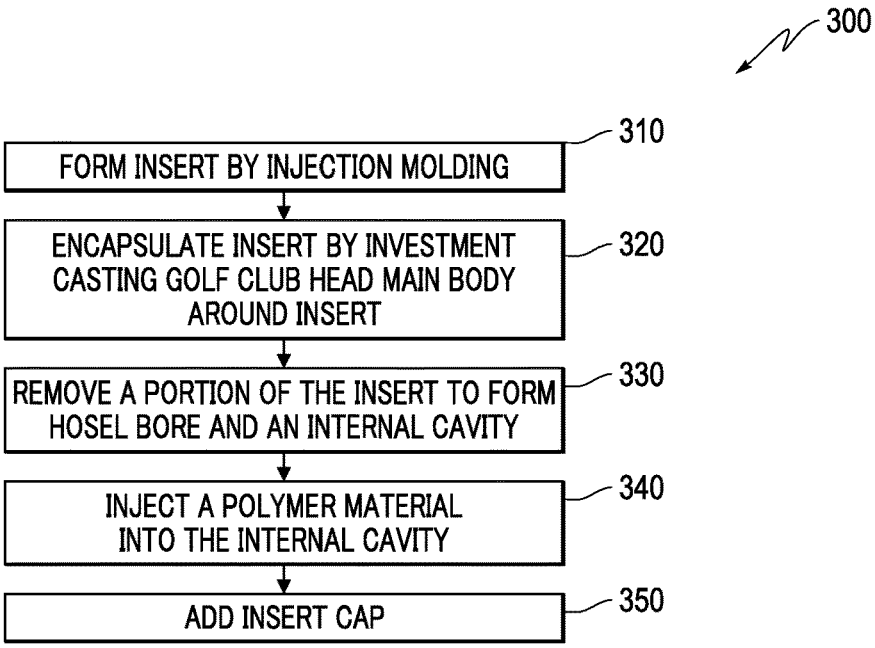
FIG. 13 shows an exemplary method of manufacturing a golf club head in accordance with one or more aspects of the present disclosure.
Figure 14:
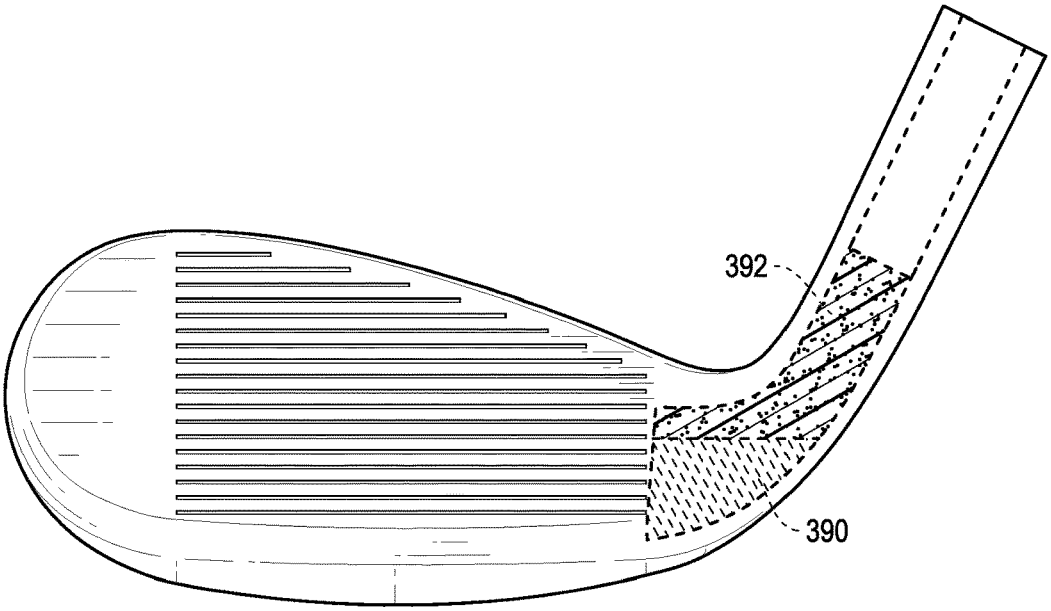
FIG. 14 shows a golf club head resulting from a fourth step of the method of FIG. 13.
Figure 15:
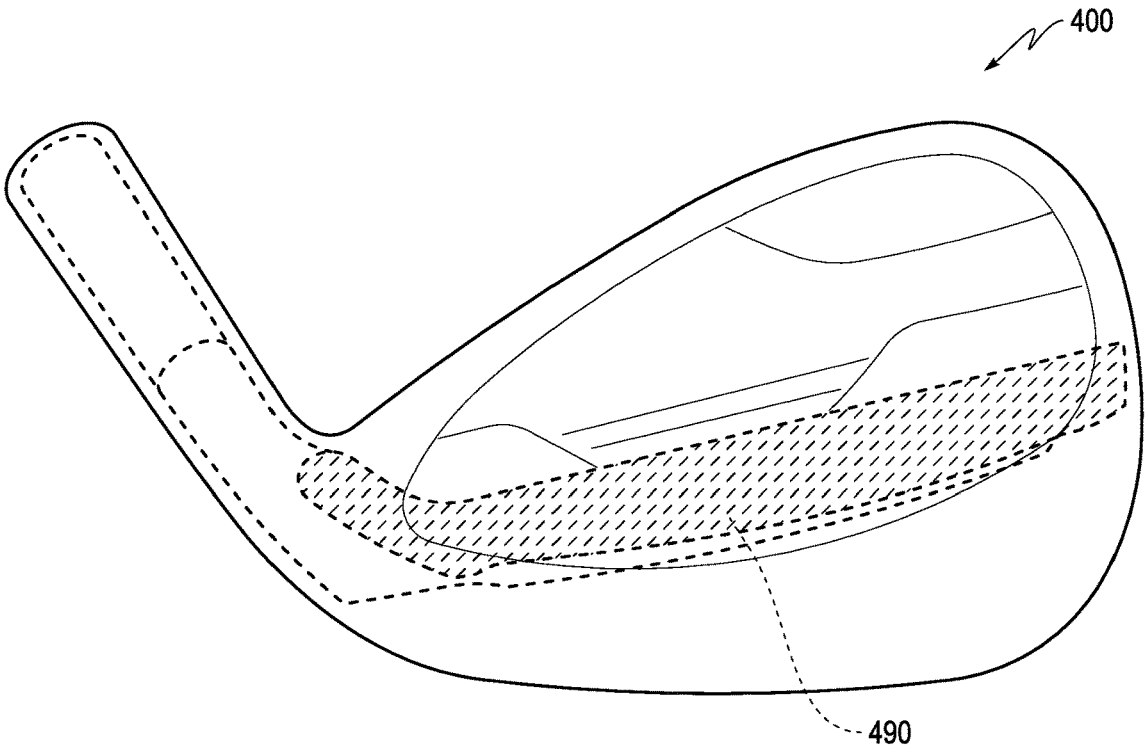
FIG. 15 shows a rear cutaway view of a golf club head in accordance with one or more aspects of the present disclosure.
Figure 16:
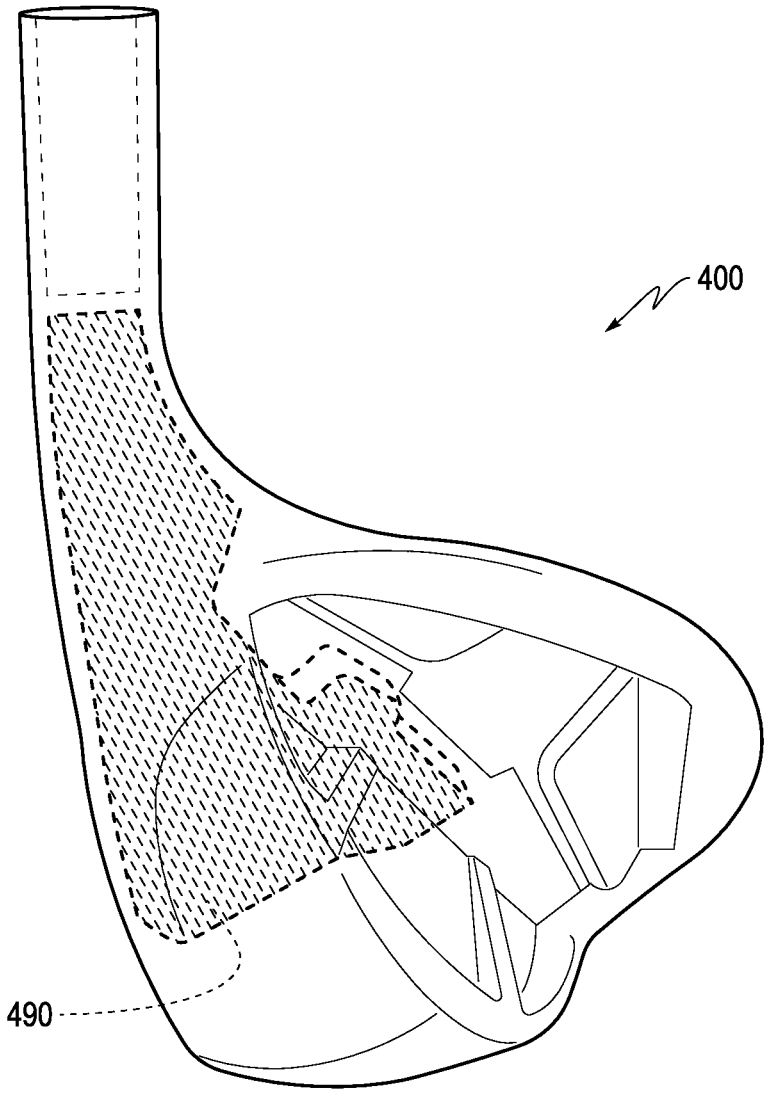
FIG. 16 shows a heel-side cutaway view of the golf club head of FIG. 15.

Other exemplary club heads are seen as being within the spirit and scope of the present invention. For example, as shown in FIG. 13 and like the method of FIG. 7, an insert 390 may first be formed at a first step 310 by, e.g., injection molding, and the main body of the golf club head may then be formed around the insert at a second step 320 by, e.g., investment casting. But at a third step 330, instead of removing only the upper part of the insert so as to form the hosel bore of the hosel portion, more of the insert may be removed so as to form an internal cavity below the hosel bore. More specifically, and as shown in FIG. 14, part 392, e.g., at least 50% by volume, or all of the insert may be removed by, e.g., mechanical agitation, chemical etching, or electrolytic etching, to form the internal cavity. In some aspects, the insert may be comprised of a material having high solubility in water or aqueous solutions. In such aspects, the insert may be easily dissolved out of the golf club head to form the cavity. This cavity may then be filled at the fourth step 340 in FIG. 13 by injecting therein material such as a polymer foam that later solidifies. This fourth step may thus introduce a vibration dampening material within the club head or allow tuning of the location of the center of gravity by, e.g., varying the density of the polymer material. And as in the method of FIG. 7, an insert cap may then be introduced at a fifth step 350 into the hosel bore so as to rest on the metal shelf delimiting the bottom of the hosel bore.

Figure 17:
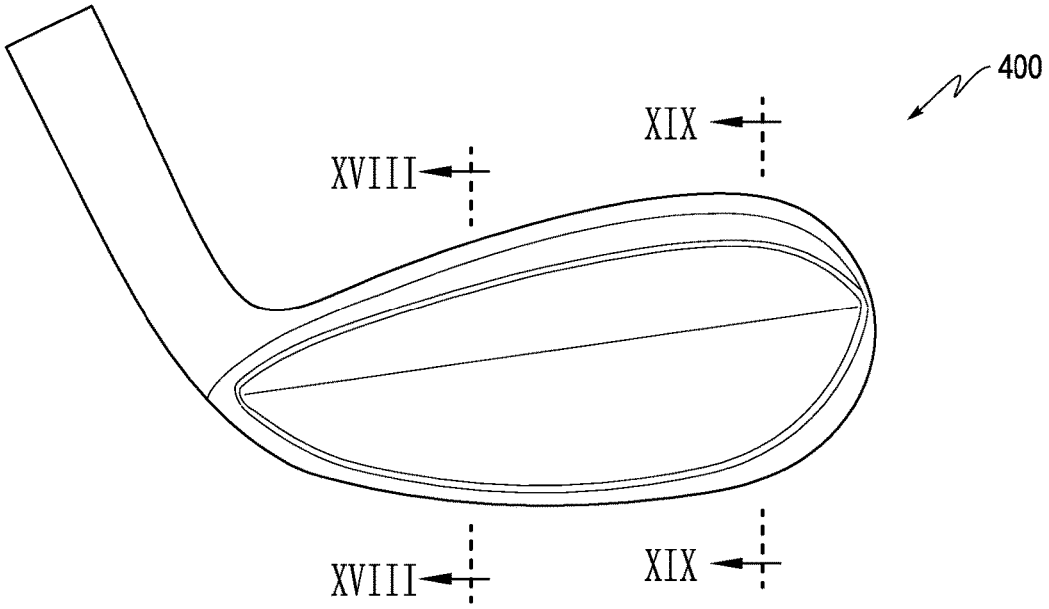
FIG. 17 shows a rear schematic view of the golf club head of FIG. 15.
Figure 18:
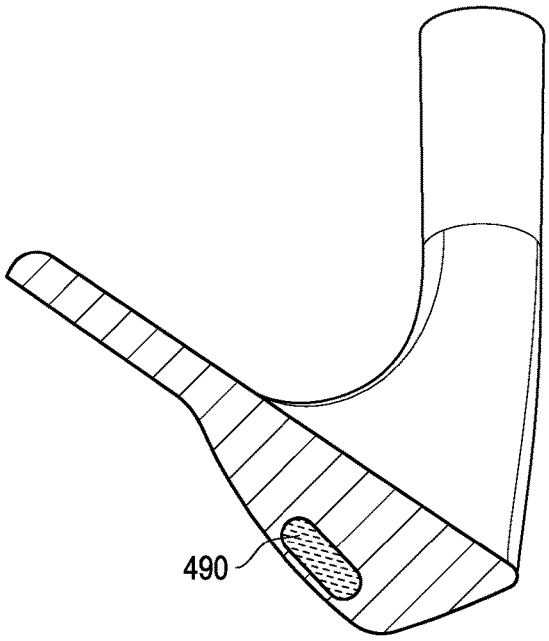
FIG. 18 shows a cross-section of the golf club head of FIG. 17 along the line XVIII-XVIII.
Figure 19:
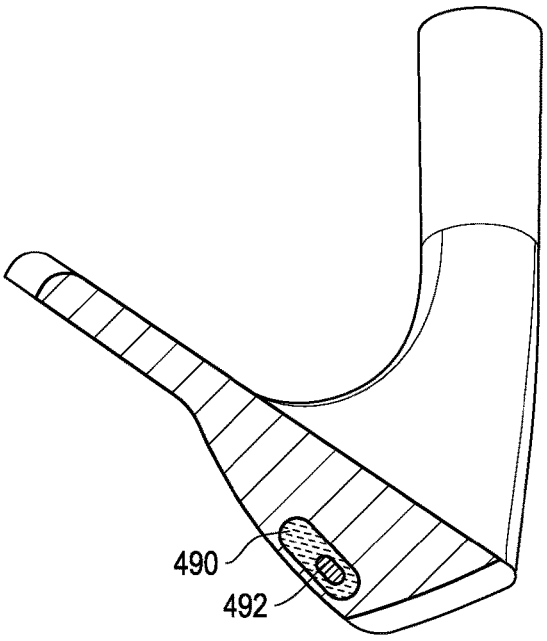
FIG. 19 shows a cross-section of the golf club head of FIG. 17 along the line XIX-XIX.
Figure 20:
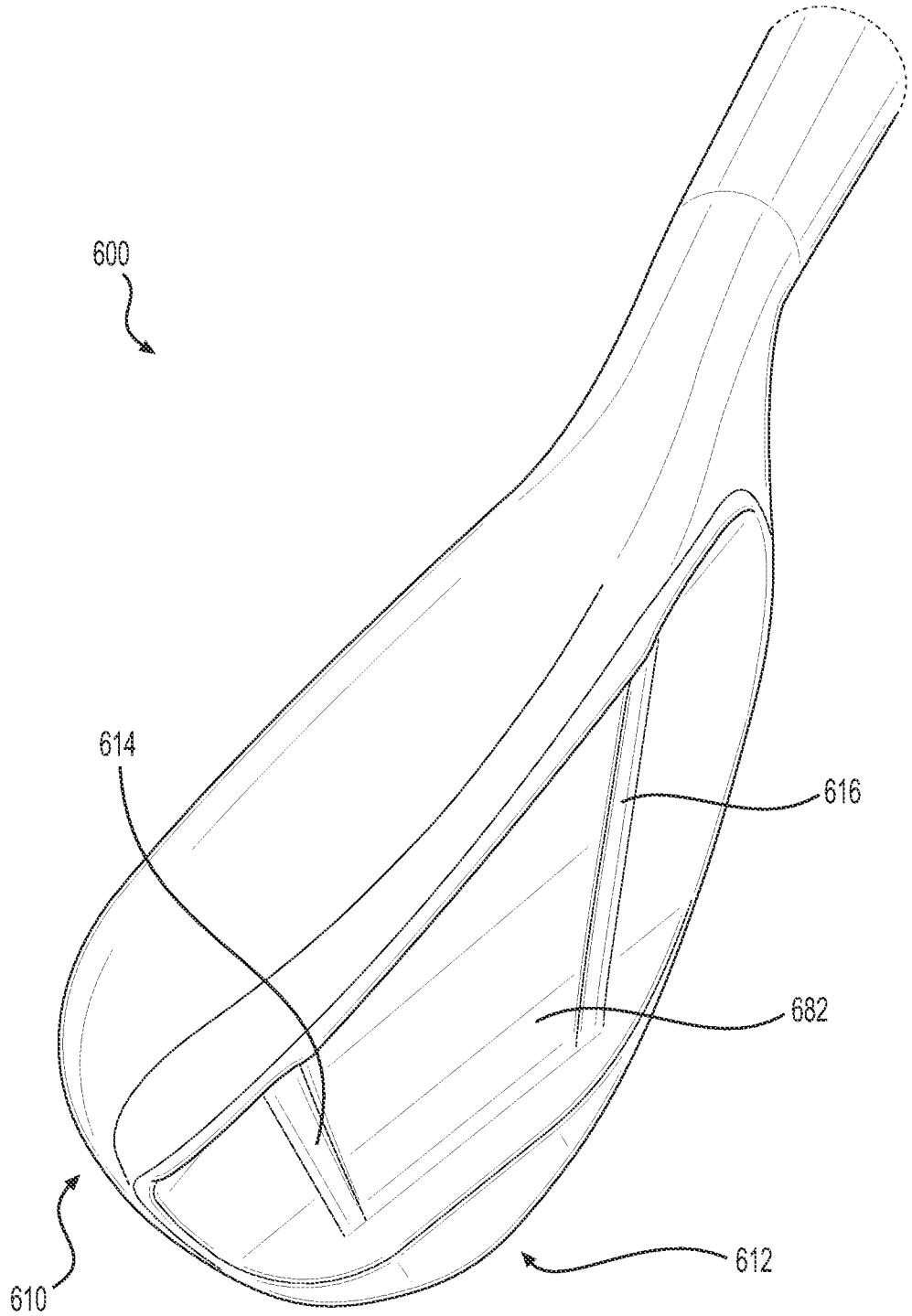
FIG. 20 shows a rear perspective view of a golf club head in accordance with a second embodiment of the present disclosure.
Figure 21:
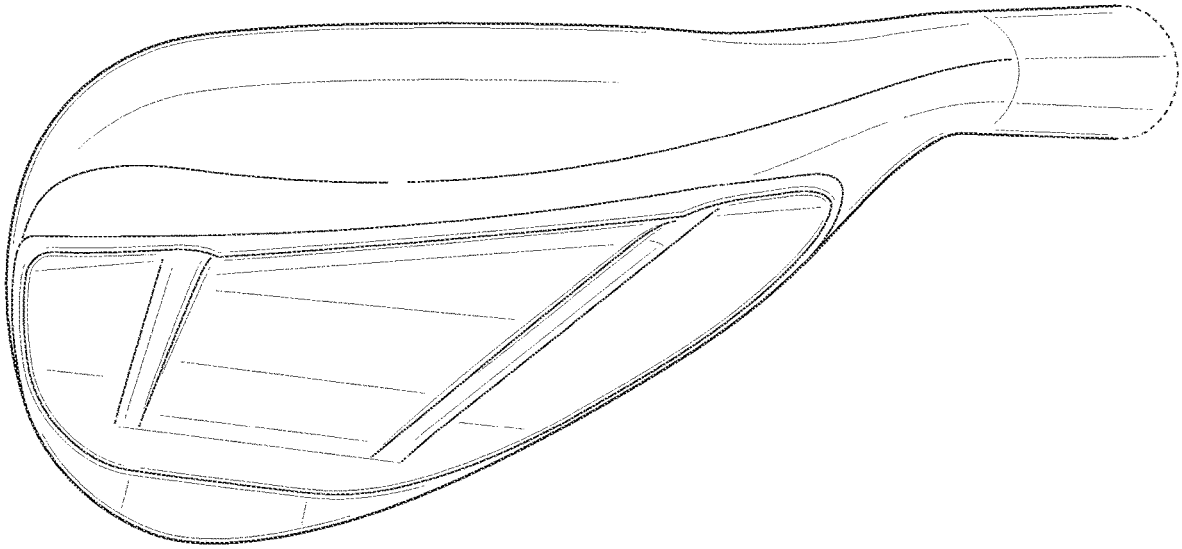
FIG. 21 shows a bottom plan view of the golf club head of FIG. 20.

Yet other exemplary club heads are considered as being within the spirit and scope of the present invention. For example, as shown in the exemplary golf club head 400 of FIGS. 15-19, the insert 490 may extend even farther into the sole portion or to the toe portion of the golf club head. This insert may in fact extend the entire distance from the heel to the toe. Such a configuration may be more feasible in "game-improvement" type golf club heads, which generally have a larger sole volume to accommodate such an insert. The golfer using a "game-improvement" club head may also find less objectionable any changes in sound and/or feel that result from the insert extending into the striking face. In fact, the presence of the insert may provide a vibrational dampening effect and improve feel on off-center impacts. And as shown in FIG. 19, which shows a cross-section taken along the line XIX-XIX of the golf club head of FIG. 17, a high density portion 492 may be co-molded with or otherwise located within the insert at the toe portion. This high density portion may be a metallic material, e.g., a tungsten alloy, and it may have a density greater than 10 g/cm$^3$. Including such a high density portion in the insert may be beneficial because it can add mass to the toe portion of the golf club head to increase MOI, it can improve feel of the golf club head upon striking a golf ball, and it may ultimately reduce manufacturing costs.

Based on the above structural advancements, e.g. increases in discretionary mass while maintaining a relatively laterally centered center of gravity, greater attention may be provided in accommodating the golf club head to the particularly intended user. In considering desirable relocation of mass, a model is generated representative of impact probability for each of a plurality of locations about the striking face of the club head. Next, particular performance characteristics, e.g. ball speed upon impact and/or average carry distance, are measured at each of the plurality of locations about the striking face. By associating the probability model with such performance characteristics, a system could be generated that aggregates such information and, on that basis, calculates an overall performance value representative of what a golfer may expect to achieve over a large sampling of golf shots throughout play.

As a result of the generation and execution of such model, various attributes were deemed relatively acceptable, or subject to minimal returns in the case of further manipulation. Yet other attributes were viewed as ripe for further manipulation. In other words, where varying certain attributes may deleteriously affect other attributes, adopting a model using probability-based overall performance may help point to a most desirable combination of attributes.

In particular, and by way of example, increasing Iyy was viewed as worthy of greater consideration. In the specific case of wedge-type golf club heads, golfers tend to impact golf balls on the striking face with high variation in the vertical direction (as compared with say lower-lofted iron-type golf clubs). Yet, the lateral position of the center of gravity remains an important characteristics of a wedge-type golf club head. Other golf club head aspects are also particularly significant, for example the height of the sweet spot on the striking face.

For these reasons, a desire has been identified to largely maintain various desirable characteristics such as sweet spot height and the relatively centered lateral placement of the center of gravity—or at least limit manipulation of those—in favor of manipulating other characteristics, such as to significantly increase Iyy.

This more desirable combination of properties may be achieved in various ways. For example, and as described above, the low density insert 190 may comprise a greater mass, a greater volume and thus a greater percent volume and percent mass of the overall golf club head.

First, the present inventors determined that a greater insert mass is viable without diminishing the structural integrity of the golf club head below an acceptable threshold. Second, greater insert volume may be achieved if plural, different low-density inserts are implemented across a set or portfolio or offering of plural loft-varying golf club heads. If the auxiliary insert had been limited to a single, identically structured component across all differently lofted (and otherwise differing) club heads of a set or portfolio, a design envelope within which the low density insert may fit was considered to be the net overlapped space of all such golf club heads superimposed on each other in like orientation. If, instead, plural different low-density inserts are permitted to be incorporated into a set of differently-lofted club heads, then fewer overlapped club heads need be superimposed per low density insert or no overlapping at all. As a result, in general, the design envelopes may be larger, permitting greater overall design freedom across the set or offering.

According to the above, the low-density insert preferably has a density no greater than 4 g/cc, more preferably no greater than 3 g/cc and even more preferably no greater than 2.5 g/cc, yet more preferably, equal to about 2 g/cc. Additionally, or alternatively, the low-density insert has a mass, Ma, no less than 4 g, more preferably, no less than 5.5 g, more preferably no less than 6 g, and even more preferably within the range of 6 g to 8 g. While greater mass here naturally results in greater discretionary mass, the upper limit in this case acknowledges practical manufacturing considerations, which may tend to place downward pressure on mass in view of maintaining the structural integrity of the club head for a normal range of use cases. Furthermore, to the extent increases in mass result from extension of the auxiliary insert toeward of the heelwardmost extent of the scorelines, diminishing returns may exist as mass removed proximate a central location of the club head may have a lesser effect on MOI versus mass removal from locations at club head extremities. Additionally or alternatively, the low-density insert includes a volume no less than 2 cc, more preferably no less than 2.75 cc, more preferably within the range of 2.75 cc to 4 cc. This range reflects similar considerations described with regard to auxiliary insert mass.

Additionally, or alternatively, in some embodiments the auxiliary insert mass, Ma, constitutes a relative large proportion of the overall mass of the club head, Mh. The overall club head mass, Mh, is preferable at least 250 g and/or no greater than 320 g. More preferably, Mh is no less than 275 g and no greater than 310 g. Most preferably, Mh is within the range of 285 g to 305 g. Preferably, a ratio Ma/Mh is no less than 0.0185 and in some such embodiments no less than 0.020. Additionally, in some such embodiments, the ratio Ma/Mh is within the range of 0.0185 to 0.0275. Such parameters may signify the degree to which discretionary mass is generated for relocation in more beneficial regions of the club head and also signify the degree to which mass is removed from less beneficial regions, thereby maintaining e.g. a relatively laterally centered center of gravity location relative face center as described herein.

However, as described above, applying plural low-density inserts to a set or offering of differently-lofted club heads permits greater design freedom, at least with regard to particular lofts. An offering, as used herein, refers to a plurality of products having similar aesthetic and functional characteristics as to be intended to be and appear as a single product line, whereupon a user is expected to select, from the offering, a set of all or fewer than all of the products of the offering to constitute a set or a portion of a set of golf clubs or golf club heads. A set, or correlated set, as used herein, refers to a plurality of products having similar or correlated functionality and/or aesthetics, either sold or offered to be sold in combination. Therefore, in addition or alternatively to the above, low-density insert volume is preferably related to loft throughout a set or offering in the following manner:

$$\text{Volume} \geq 0.0279\ \text{cc}/^{\circ} * \text{Loft} + 0.7805\ \text{cc}$$

Figure 30:
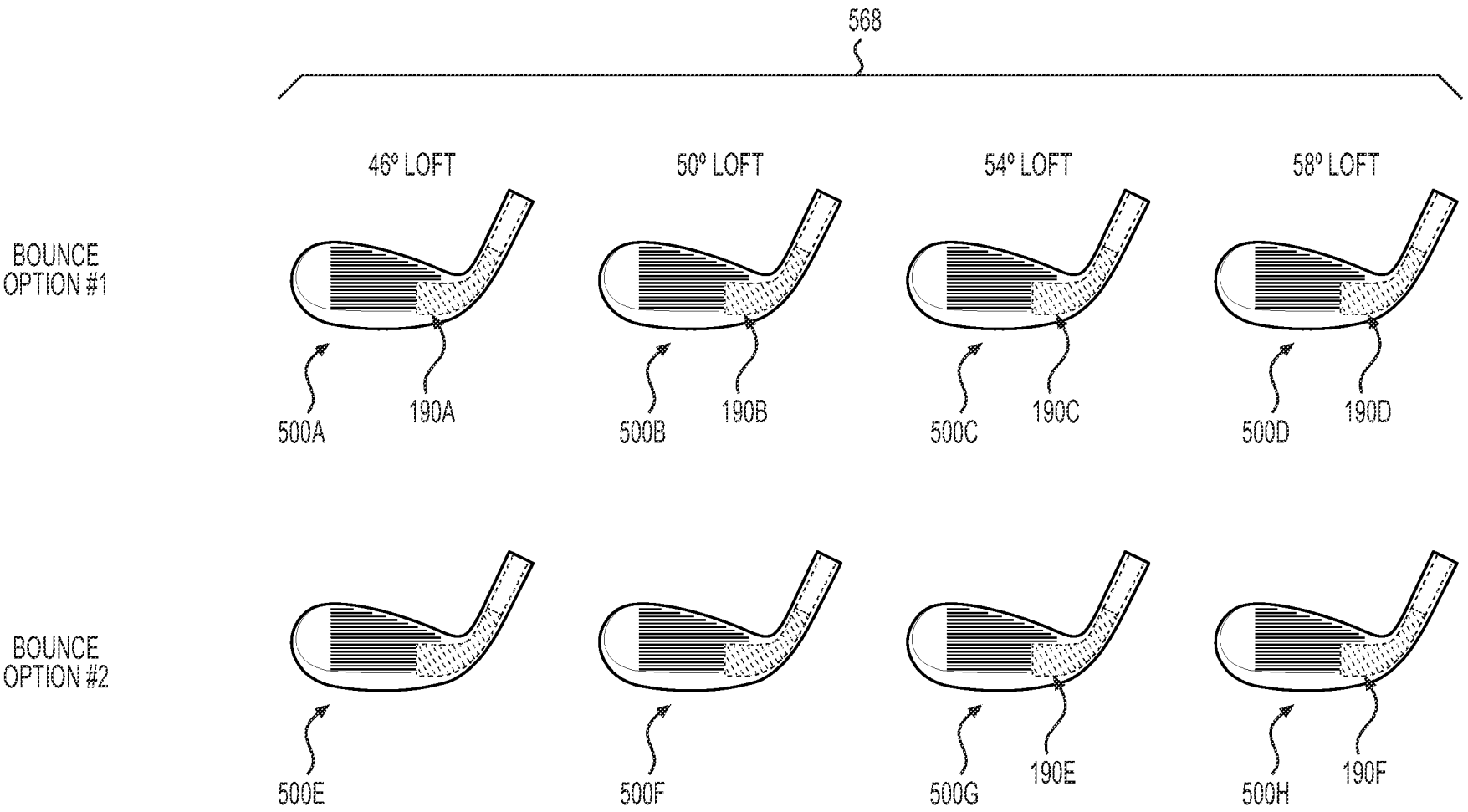
FIG. 30 shows a portfolio of golf club heads in front elevation view in accordance with another embodiment of the present disclosure.
Figure 33:
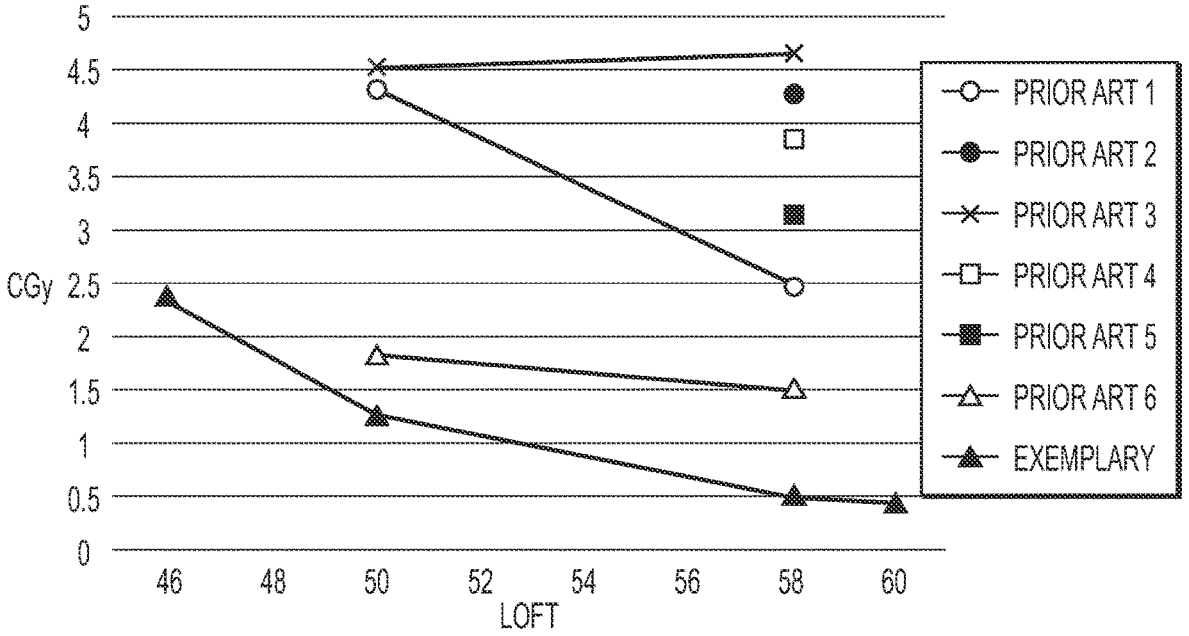
FIG. 33 shows a plot comparing loft to CGy for various golf club heads.
Figure 34:
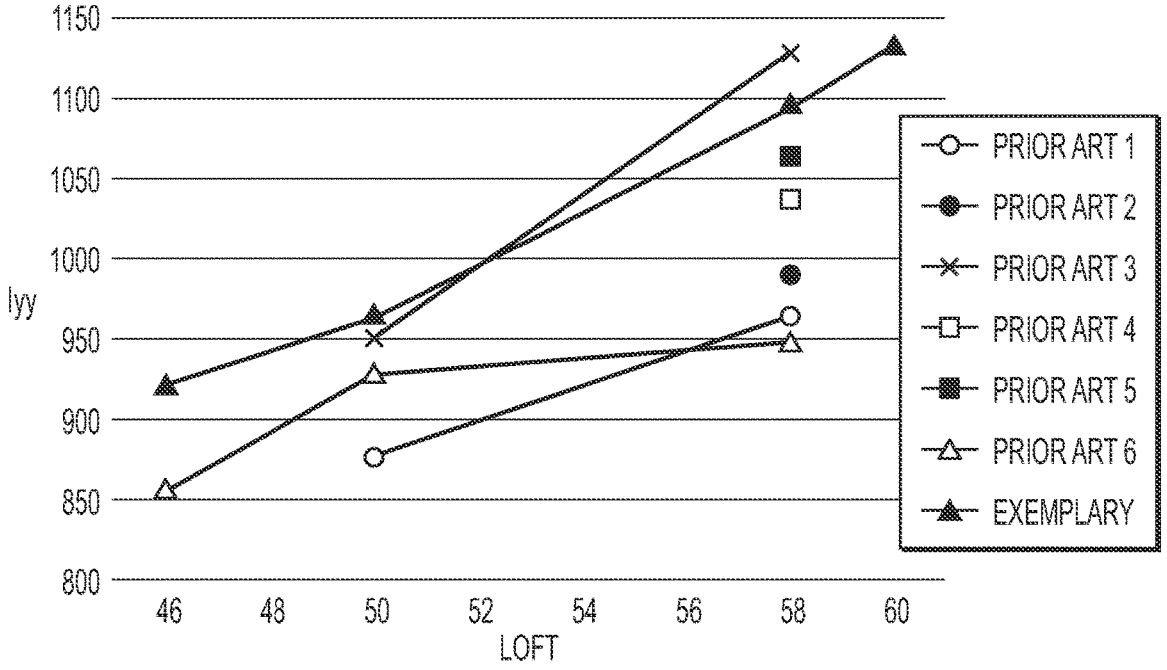
FIG. 34 shows a plot comparing loft to Iyy for various golf club heads.
Figures 35, 36:
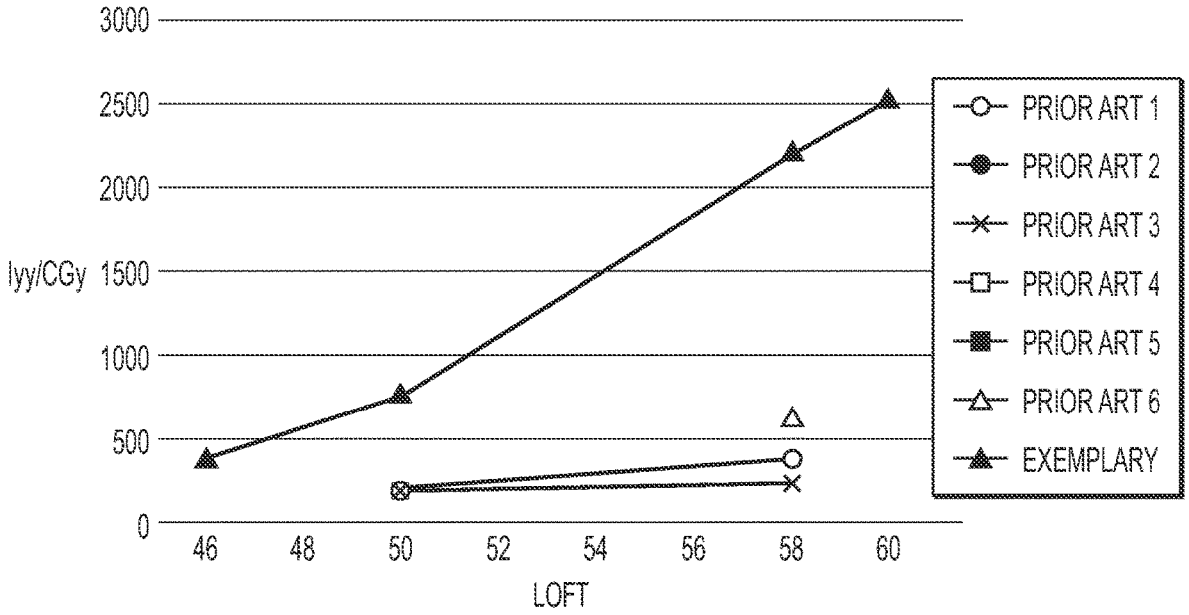
FIG. 35 shows a plot comparing loft to Iyy/CGy for various golf club heads.
FIG. 36 shows a table listing various parameters of exemplary golf club heads.

As an example, with reference to FIG. 30, a portfolio of golf club heads from which various sets of golf club heads may be arranged is shown in accordance with the above disclosure. The portfolio includes a first sub-set of golf club heads, 500A through 500D each preferably sharing a same effect bounce (Bounce Option #1), but varying progressively in loft. The portfolio also includes a second sub-set of golf club heads each sharing a same second bounce offering (Bounce Option #2), yet varying progressively in loft. A first correlated set of iron-type, more specifically, wedge-type club heads may constitute at least two, more preferably at least three differently lofted club heads selected from among the first sub-set. A correlated set of club heads may similarly be considered to constitute two or more differently-lofted club heads selected from the second sub-set. In some alternative embodiments, a correlated set may be composed of differently-lofted club heads having different effective bounce attributes. Properties of the club heads and inserts of Bounce Options #1 and #2 are shown in FIG. 31. The golf club heads 500A through 500H may each include one of low-density inserts 190A through 190F in accordance with the present disclosure, the low-density inserts having properties and shapes as shown in FIGS. 32A-32H.

As shown in the chart and images of FIGS. 32A-32H, it is thus contemplated that a set of golf club heads (e.g. set or offering 568), e.g. wedge-type golf club heads, of at least four club heads, having unique lofts, may contain low density inserts (in the manner described with regard to FIG. 1) that differ from one specifically-lofted club head to another differently-lofted club head and/or differ with variation in another characteristic, e.g. bounce offering. More particularly, at least six unique auxiliary inserts (190A, 190B, 190C, 190D, 190E, and 190F) are embodied in a portfolio 568 of club heads variously differing in some combination of loft and effective bounce. In some embodiments, a unique auxiliary insert is provided for each unique club head of the portfolio. However, preferably, still some club heads bear similar, or identical auxiliary inserts, from among the portfolio. Accordingly, greater discretionary mass is achieved, which discretionary mass may be relocated to more desirable regions of the club head, and removed from regions of the club head where mass removal may be desirable, e.g. proximate the heel portion and/or in close proximity to the y-axis (i.e. the horizontal heel-toe axis passing through the center of gravity of the club head when the club head is oriented in the reference position relative to a virtual ground plane). In turn, Iyy may be further increased.

Figure 22:
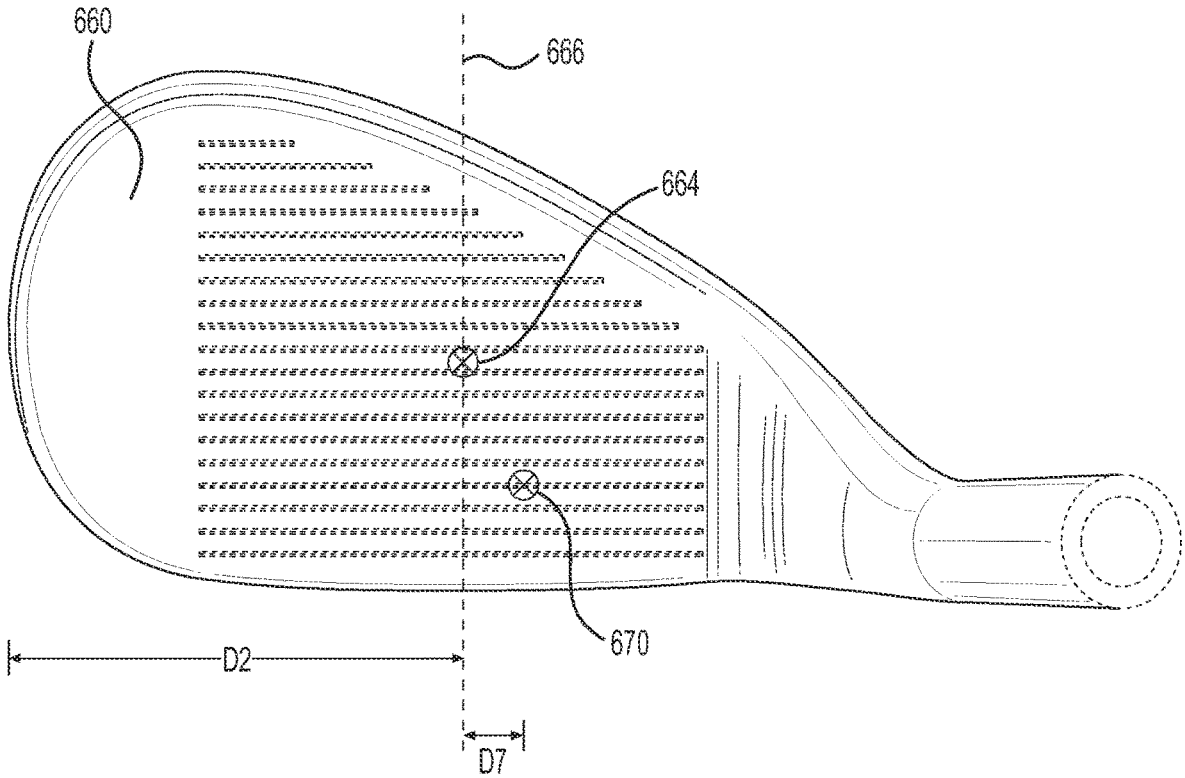
FIG. 22 shows a top plan view of the golf club head of FIG. 20.

Preferably in combination with enlarging the low-density insert as discussed above, mass is relocated to various extremities of the club head, preferably proximate the hosel portion. For example, the hosel may be lengthened as a result of incorporating the low-density insert. Preferably the hosel length is no less than 78 mm, more preferably no less than 80 mm, even more preferably equal to about 85 mm, but preferably not exceeding 90 mm. In some such embodiments, hosel length may be considered a function of loft, where lower lofted club heads bear a lower hosel length and higher-lofted club heads bear a greater hosel length. For example, a club head according to the embodiment of FIG. 1 having a loft of about 42° to about 52° may bear a hosel length between about 75 mm and 82 mm, more preferably about 80 mm, whereas a club head according to the embodiment of FIG. 1 having a loft of about 56° to about 64° may bear a hosel length between about 83 mm to 88 mm, more preferably about 84 mm. In this manner, moment of inertia properties are further improved. For example, Iyy is likely to increase as mass is relocated to regions more vertically distant relative to the y-axis. Izz may be increased as mass is relocated to regions more laterally distant from the z-axis about which Izz is measured. Furthermore, such attributes take advantage of the belief that impact variation, from a probability standpoint, increases with loft, thereby increasing the reward attributably to gains in Iyy with loft. Furthermore, given that mass is removed proximate heel-ward locations and relocated proximate the hosel, the desirable lateral (heel-to-toe) positioning of the center of gravity may be generally maintained (changes in distance from an axis has a significantly greater effect on MOI than on center of gravity location). Preferably, the center of gravity 670 is spaced from the virtual vertical center plane 666 by a distance D7 (see e.g. FIG. 22) that is no greater than 5 mm. However, provided the greater mass and volume of the low-density insert, even greater enhancements to this dimension may be achieved. Accordingly, D7 is more preferably no greater than 2.5 mm, and even more preferably no greater than 1.25 mm.

In addition, the center of gravity 670 preferably has a depth from the striking face plane 676, D5, (see FIG. 23) measured normal to the striking face plane where a positive value corresponds with a rearward direction, of no greater than 2.5 mm, more preferably no greater than 2.25, and even more preferably no greater than 2 mm. In some embodiments, the depth of the center of gravity may be a negative value indicating that the center of gravity is forward of the striking face. Such embodiments are particularly viable as a large amount of discretionary mass is incorporated into the hosel. These values on one hand indicate that the golf club head, in qualitatively terms, is blade-like, or solid, in appearance and/or feel. On the other hand, these values may serve as an indication that the club head sweet spot is relatively low on the striking face, which may be considered a particularly desirable feature with regard to wedge-type golf club heads, in consideration of the golf club head's ability to generate beneficial spin upon impact.

Additionally or alternatively, the depth of the center of gravity, D5, is preferably related to club head loft. For example, preferably, $D5 \leq 7.69\ mm - 0.074\ mm/° * L$. More preferably, $D5 \leq 7.19\ mm - 0.074\ mm/° * L$. These relationships ensure the benefits described above associated with D5 in absolute form, but take into account the natural tendency of D5 to vary in correlation with club head loft.

Based on the above configurations, Iyy is preferably no less than 1000 $g*cm^2$ and more preferably no less than 1100 $g*cm^2$. Additionally, or alternatively, Izz is preferably no less than 3000 $g*cm^2$, more preferably no less than 3250 $g*cm^2$, and even more preferably no less than 3300 $g*cm^2$. These values are believed to increase expected ball carry distance and/or expected ball impact velocity as considered across an array of locations about the striking face using a probability-based model as described above, thereby increasing the overall expected performance of the golf club head.

Figure 23:
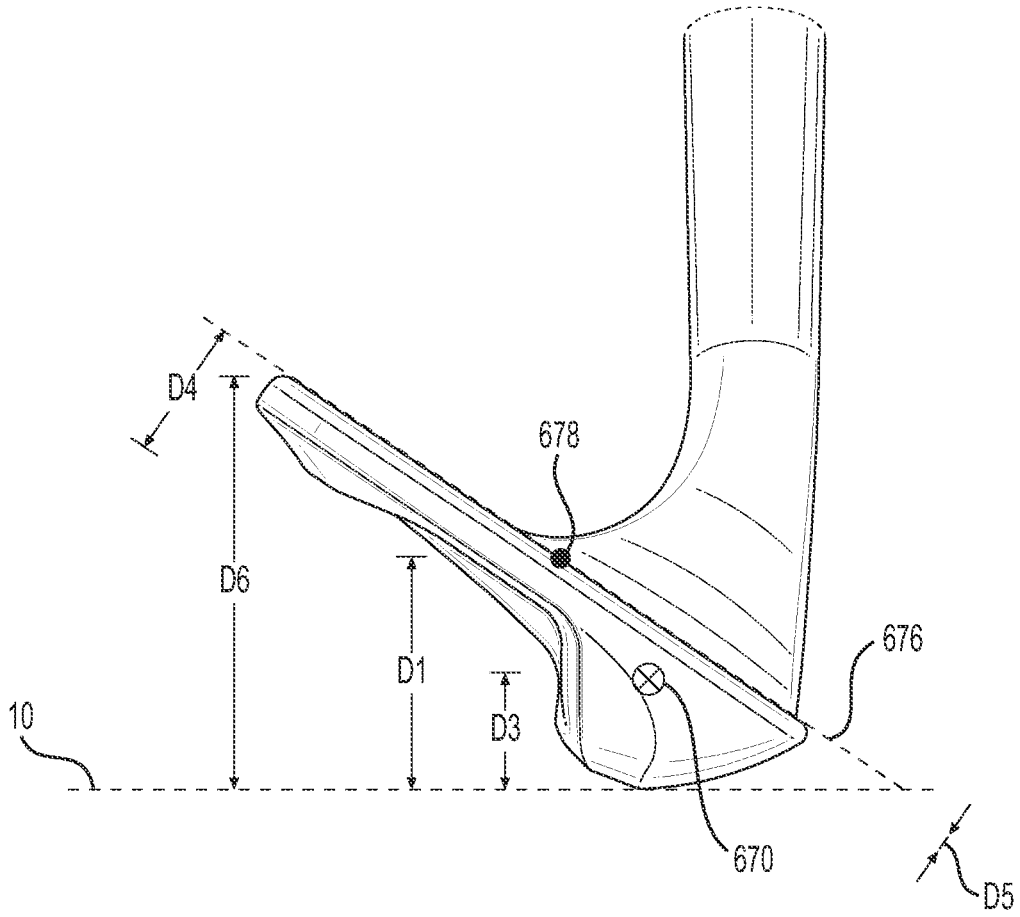
FIG. 23 shows a toe-side elevation view of the golf club head of FIG. 20.
Figure 24:
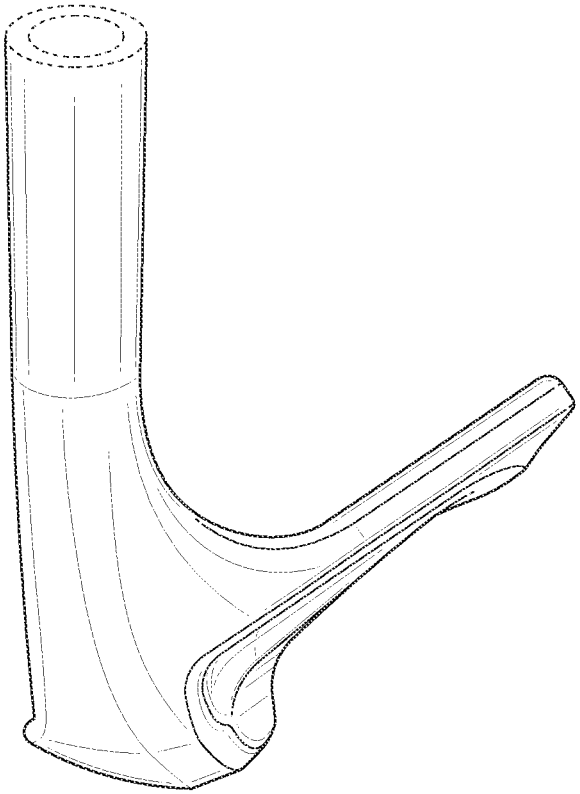
FIG. 24 shows a heel-side elevation view of the golf club head of FIG. 20.
Figure 25:
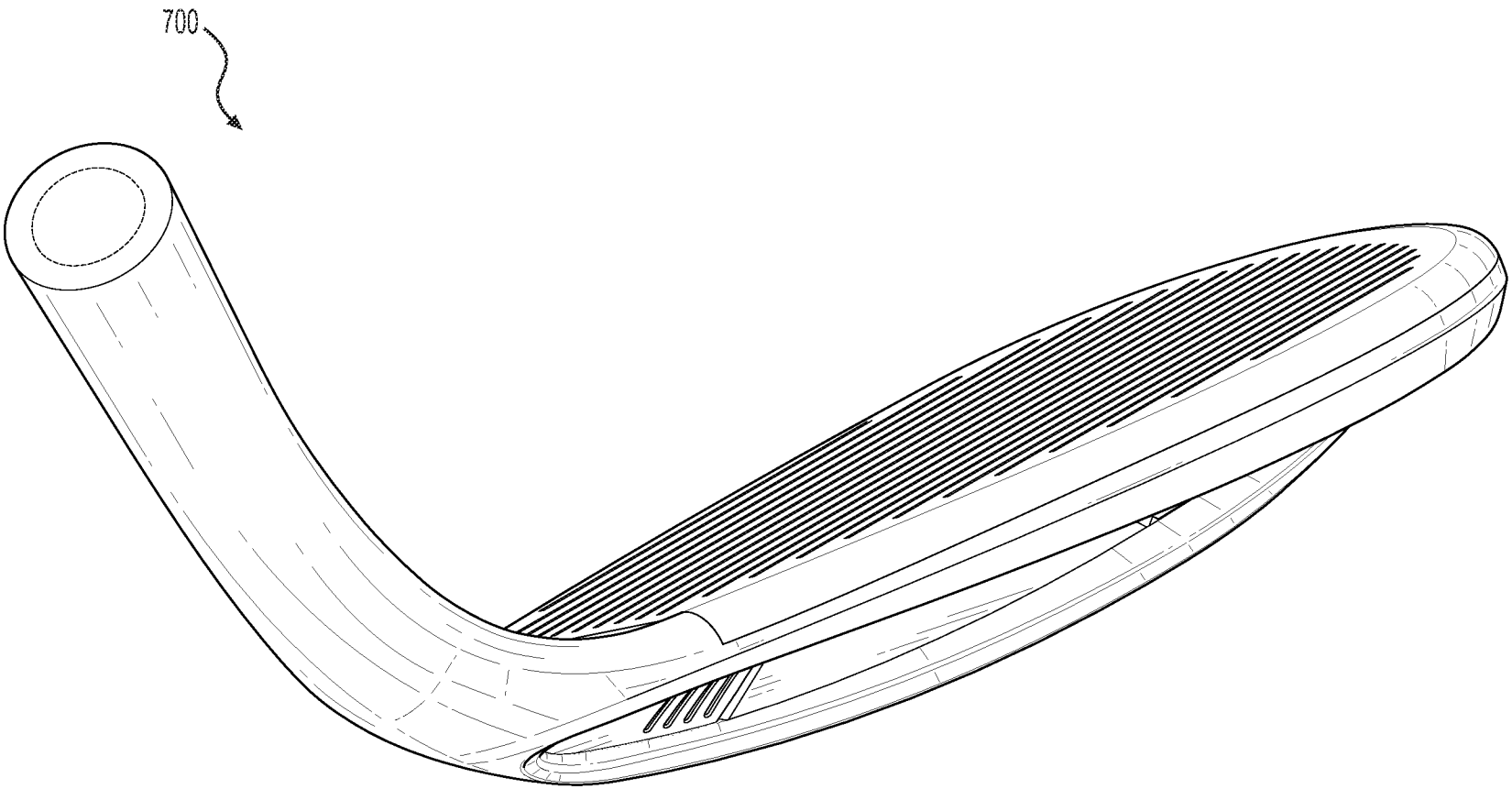
FIG. 25 shows a perspective view of a golf club head in accordance with a third embodiment of the present disclosure.
Figure 26:
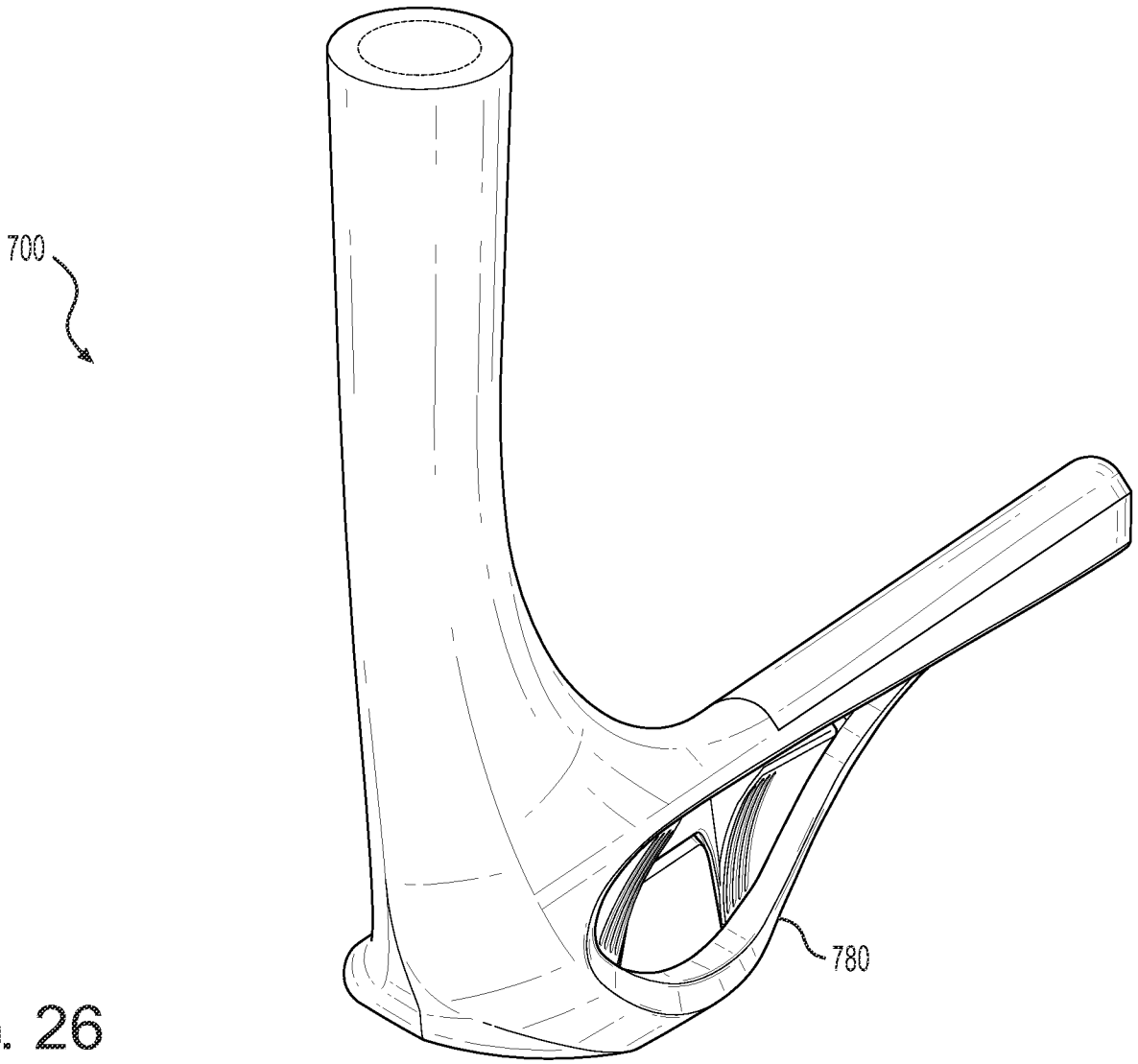
FIG. 26 shows a heel-side elevation view of the golf club head of FIG. 25.
Figure 27:
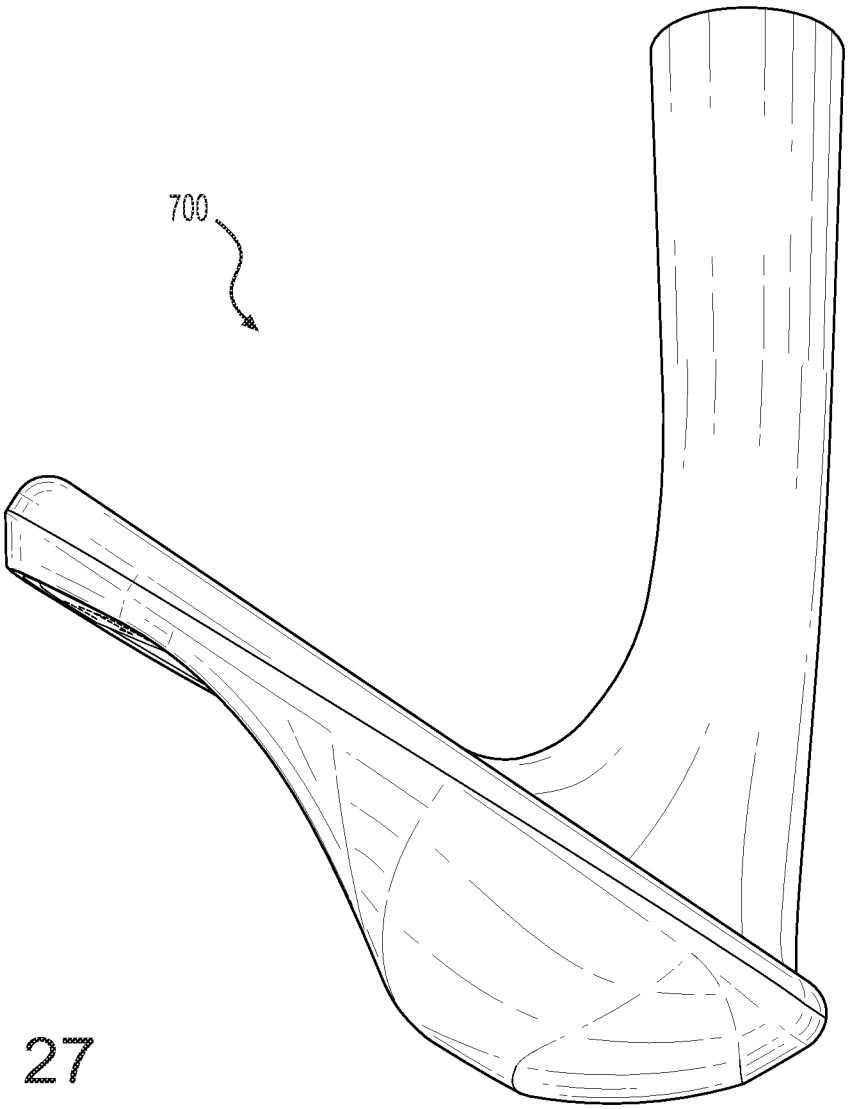
FIG. 27 shows a toe-side elevation view of the golf club head of FIG. 25.
Figure 28:
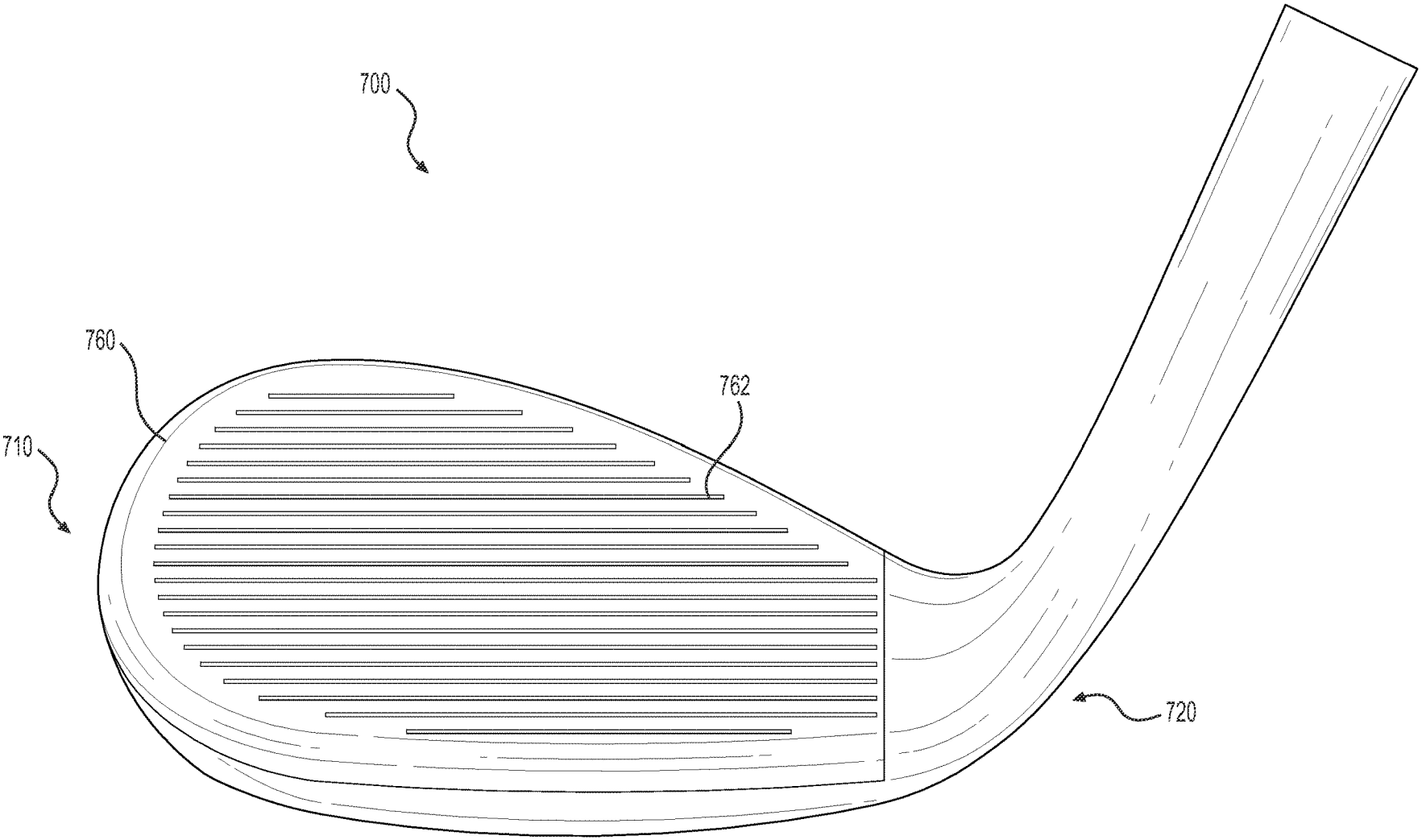
FIG. 28 shows a front elevation view of the golf club head of FIG. 25.
Figure 29:
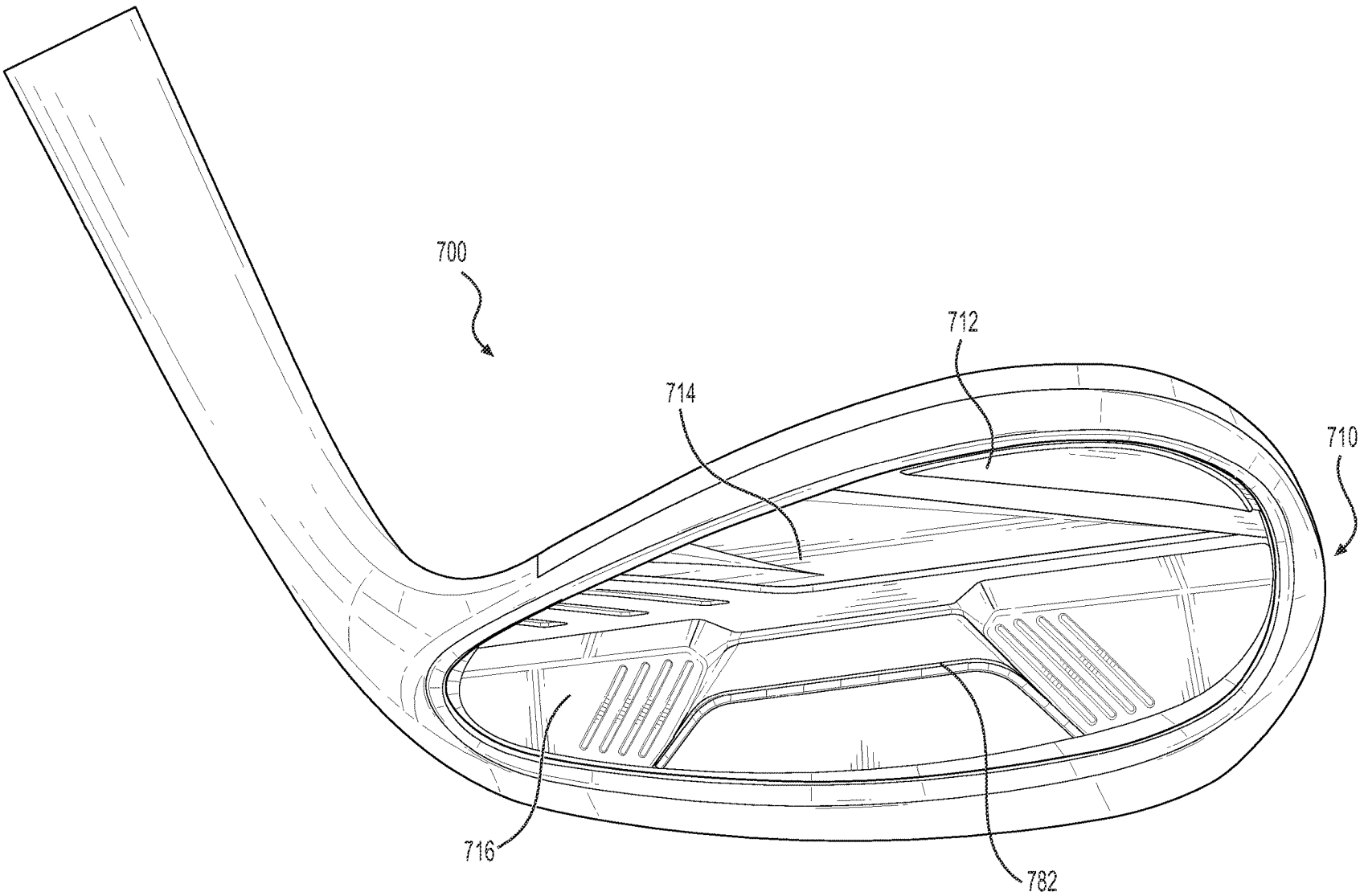
FIG. 29 shows a rear elevation view of the golf club head of FIG. 25.

With reference to FIG. 23, in addition or alternatively, the sweet spot 678 of the club head has a height, D1, measured vertically from the virtual ground plane 10 of preferably no greater than 24 mm, more preferably between 19 mm and 23 mm. Relatedly, the center of gravity has a height, D3, that is preferably no greater than 22 mm and more preferably in the range of 19 mm to 21.5 mm. Additionally or alternatively, the club head has an overall depth, D4, measured rearward from the striking face plane and in a direction perpendicular to the striking face plane, of preferably no greater than 23 mm, more preferably no greater than 22 mm and even more preferably within the range of 17 mm to 22 mm. The club head further has a toe width dimension, D2, being the lateral distance between the face center and the toe-ward-most extend of the club head. D2 is preferably no less than 44 mm, more preferably no less than 45 mm, and even more preferably within the range of 45 mm to 48 mm. Additionally or alternatively, the club head includes a club head height dimension, D6, being the vertical extent of the body of the club head excluding the hose) portion. The height D6 is preferably no less than 38 mm and more preferably within the range of 39 mm to 49 mm.

As described above, in view of probability-based modelling, it is contemplated that it may be more desirable to enhance Iyy while maintaining or providing less enhancement to Izz. Accordingly, a ratio of Iyy/Izz is preferably no less than 0.25, more preferably no less than 0.28, even more preferably no less than 0.30 and yet even more preferably no less than 0.32. Preferably, such ratio is within a range of 0.30 to 0.35. Such characteristics further improve the overall probability-based expected performance of the club head.

In addition to the above, it has been discovered that club head loft plays a particularly significant role in establishing appropriate trade-offs between—and therefore relationships governing—various mass-related parameters of the golf club head. For example, it is believed that, from a probability standpoint, increasing loft results in greater user impact variation vertically about the striking face of the club head. This discovery resulted in a focus on the manner in which Iyy varies with loft, particularly applying greater attention to increasing Iyy as loft increases, in some cases at the cost of other attributes deemed less significant.

Accordingly, Iyy is preferably related to loft in the following manner, for a club head (or two, three, or preferably all club heads of a set or portfolio of club heads):

$$Iyy \geq 16.63\ g\cdot cm^2/^\circ \times L + 114\ g\cdot cm^2.$$

While increasing Iyy is desirable with increasing loft, such goal may come at the cost of increases in lateral spacing of the center of gravity from the face center (D7 in practical terms). While some increase in D7 may be deemed acceptable, thresholds are preferably still applied that limit such inadvertent increases. As a result, Iyy, D7 and loft are preferably related as follows:

$$Iyy/D7 \geq 527.4\ g\cdot cm^2/^\circ \times L + 23{,}580\ g\cdot cm.$$

More preferably, Iyy, D7, and loft are related as follows:

$$Iyy/D7 \geq 527.4\ g\cdot cm^2/^\circ \times L + 22{,}170\ g\cdot cm.$$

Even more preferably, Iyy, D7, and loft are related as follows:

$$Iyy/D7 \geq 527.4\ g\cdot cm^2/^\circ \times L + 20{,}760\ g\cdot cm.$$

Additionally, or alternatively, D7 is related to loft for a club head (or two, preferably three, more preferably all club heads of a set or portfolio of club heads) in the following manner:

$$D7 \leq 10.1\ mm - 0.135\ mm/^\circ \times L.$$

More preferably, D7 is related to loft for a club head (or two, preferably three, more preferably all club heads of a set or portfolio of club heads) in the following manner:

$$D7 \leq 8.75\ mm - 0.135\ mm/^\circ \times L.$$

Such relationships ensure that efforts to raise moment of inertia, particularly Iyy, and particularly for higher-lofted club heads, do not result in unnecessary overall losses in performance due to inadvertent increases in D7.

Additionally, or alternatively, Iyy is preferably related to loft in the following manner:

$$Iyy \geq 16.63\ g\cdot cm^2/^\circ \times L + 114\ g\cdot cm^2.$$

The uniqueness of these relationships may be shown by way of example from the table and plots of FIGS. 33-36 comparing an exemplary embodiment of the present disclosure to known prior art golf clubs. For purposes herein "CGy" is definitionally equivalent to D7.

As described above, one sought after feature particular to wedge-type golf club heads is their ability to generate backspin upon impact. In addition to the features described above, such as sweet spot location and moment of inertia, other golf club head aspects may aid in contributing to backspin generation. Some such attributes are the surface roughness characteristics of the striking face.

Surface roughness of a striking face of an iron-type, e.g. a wedge-type, golf club head is regulated in various manners by organizations that promulgate rules governing the play of professional golf, e.g. the United States Golf Association (USGA). In particular, the USGA has promulgated rules governing equipment, including rules limiting aspects of surface roughness. These rules in part are considered to limit average surface roughness, Ra, to 180 μin. However, average surface roughness is but a single manner of expressing the characteristics of surface. Therefore, complex surface variations are still possible within the confines of this acceptable space.

Accordingly, with particular attention to play in wet conditions, it was found that overall performance, e.g. backspin generation, may be enhanced by appropriate selection of surface finishing processes. Preferably, aside from scorelines formed in the manner described above, the striking face is preferably textured by media blasting.

In one or more embodiments, the striking face is textured preferably by surfacing processes including media blasting. Particular processes, and the structure resulting therefrom, have been shown to raise overall backspin generation, more specifically, to significantly increase backspin generation in wet conditions. Thus, using such processes and/or generating such finishes, gaps in spin performance typically understood to exist between dry conditions and wet conditions are minimized, resulting in not only greater overall backspin generation, but more consistent club head performance in use.

In some such embodiments, a process of surface finishing a club head striking face include a first step of applying a coating, preferably chrome plating. Preferably subsequent to (but optionally prior to) the step of plating, a second step of applying a media blast to the striking face occurs. It is believed that the step of applying a chrome plated surface is particularly effective in wet conditions, thereby assisting to minimize a gap in spin performance between dry and wet conditions as described above.

Additionally, or alternatively, the surface texture varies from club head to club head within a correlated set of club heads, e.g. the correlated set of club heads described above.

In greater detail, and by way of example, in some embodiments, the step of media blasting preferably includes applying aluminum oxide having grit of 180 to 120. However, in other cases, and particularly in view of particular lofts, the step includes applying media that constitutes a mix of 180 to 120 grit aluminum oxide with a ceramic media. Preferably such mixes are in volumetric ratio 8:1 to 10:1 aluminum oxide to ceramic, more preferably in volumetric ratio of about 9:1 aluminum oxide to ceramic.

With regard to a portfolio or correlated set of golf club heads, e.g. the club head portfolios and sets described herein, preferably, one or more higher-lofted club heads receive media blast constituting 180 to 120 grit aluminum oxide that is preferably not applied to a chrome-plated striking face surface. Additionally, preferably, one or more mid-lofted club heads of the same portfolio or set (i.e. one or more club heads each having a loft less that the higher-lofted club heads) receive a similar or identical media blast, but with the addition of having such media blast applied to a chrome-plated surface. Additionally, preferably, one or more low-lofted club heads of the same portfolio or set (i.e. one or more club heads each having a loft less that the mid-lofted club heads) receive a media blast of a mix of aluminum oxide and ceramic, preferably in greater volumetric part aluminum oxide, more preferably in volumetric ratio 8:1 to 10:1 aluminum oxide to ceramic, and even more preferably in volumetric ratio of about 9:1 aluminum oxide to ceramic. Further, preferably, for the one or more low-lofted club heads, the media blast is preferably applied to a chrome-plated surface. Incorporating ceramic in a media blast mix has been shown as beneficial in that it does not impinge the surface to the degree impinged by pure aluminum oxide, thereby resulting in surface roughness effect consistent with performance expectations specific to loft. Further, it is preferable that, in any case in which media blast is applied to a chrome-plated substrate striking face, the chrome layer is not worn through, exposing any underlying surface and thus raising concerns of rust/oxidation of such underlying surface. In addition to particular selection of media blast, and parameters governing application of such media blast such as blast time and blast angle, the chrome layer is preferably applied as to have a thickness sufficient to not wear in a manner that exposes any underlying surfaces. Additionally, or alternatively, a third step, preferably subsequent to the step of media blasting, is carried out further affecting final, finished striking face texture. Preferably, laser etching is applied to the striking face. Further, in the case of a set or portfolio, laser etching is applied in a manner that varies as a function of loft. For example, in some embodiments, the laser etching process results in horizontal "lines" interposed between scorelines. The "lines" may correspond to texture regions defining an area of the face being narrow in width, and proportionally greater in length. Such laser etching regions may correspond to singular horizontal "lines" solely extending in the heel to toe direction or, alternatively, plural line segments, each colinear, but discrete, thus forming e.g. a dash-like appearance. Such laser etching region further may be characterized as having particularly deep structural features relative to surrounding striking face portions. More preferably, the laser etching process results in a combination of horizontal "lines" and angular line segments extending at an angle (e.g. 5°-80°, more preferably 15°-60°, relative the virtual ground place and as measured in the striking face plane). Preferably the number (thus the concentration) of horizontal lines increases with loft. Further, preferably, the angle of the angled laser-etched regions increases with increasing loft (also preferably increasing the overall concentration of laser-etched regions per unit area of striking face). In part, such laser-etched regions provide further roughening, believed in a manner that is precise and has an effect of reducing Ra tolerance, thus permitting targeting of an Ra value closer to the USGA limit. The addition of laser-etched regions has been shown to increase spin performance particularly in the case of wet conditions as well. Additionally, such laser-etching provides a visual cue to the golfer of the relative degree of surface roughness per differently-lofted club head.

In some particular embodiments, a "raw" or un-plated finish is desired, as a subset of golfers prefer such an aesthetic and functional surface finish. In some such cases, the striking face lacks sacrificial coatings or other coatings intended to minimize or prevent rusting or oxidation. In some such cases, additional coatings or applications of chemicals are introduced to specifically accelerate or promote rusting or oxidation. In such cases, risk of eroding a rust-inhibiting surface may not be relevant and thus limits on e.g. media grit may be less of a concern. Thus, e.g. for a set or portfolio of club heads intending to bear a raw finish, greater variation in media grit may be applied. For example, in some such embodiments, one or more high-lofted club heads may be media blasted with 60 grit aluminum oxide, mid-lofted club heads with 120 grit aluminum oxide, and low-lofted club heads with 180 grit aluminum oxide. The 60 grit aluminum oxide media in particular is preferably not applied in the case of e.g. a chrome-plated club head. However, alternative processes may be applied to permit such grit application, e.g. by adjusting methods to thicken the chrome deposited layer.

In terms of structure, the above processes affect unique surface characteristics and in a manner that preferably varies with loft in the case of a set or portfolio. Preferably, with respect to any individual club head, surface texture characteristics are in part a function of loft.

Overall, as a threshold matter, the finished striking face preferably satisfies equipment rules promulgated by the USGA (and similar regulatory bodies). As described above, such rules are generally understood to include face texture (excluding scorelines) in iron-type club heads, having an average surface roughness, Ra, that does not exceed 180 μin. The USGA equipment rules are also understood to limit the Rz of any striking texture (excluding scorelines) of iron-type club heads to an Rz no greater than 1000 μin. Thus, preferably, regardless of loft, the golf club head resulting from the surface finishing processes described above bears an Ra no greater than 180 μin and preferably bears an Rz no greater than 1000 μin. In fact, in the case of a portfolio or set of club heads, Ra is preferably generally constant between two, more preferably three, and most preferably all differently-lofted club heads of the set or portfolio. For example, for two, three, or all club heads of a set or portfolio, varying in loft, Ra is preferably maintained within the range of 120 μin to 180 μin, more preferably 140 μin to 180 μin.

Nonetheless, despite relative consistency of Ra with varying loft, other standard surface roughness parameters are preferably the point of focus and preferably do vary as a function of loft. For example, the variation in media blast described above is believed to correlate with high (and progressively increasing with loft) developed interfacial area ratio, Sdr. This parameter, in practical terms, may be considered to be related to a surface's relative surface area. Increasing surface area, considered comparably measurable in terms of Sdr, has been shown to bear a significant increase in spin performance particularly in wet spin conditions. The striking face surface of the golf club head described above with regard to FIG. 1 preferably bears an Sdr no less than 1%, more preferably no less than 2%, and even more preferably no less than 3%. Such values, provided the unique interaction between a metallic face, elastomeric golf ball coating and moisture, result in dynamic interaction generating high performance with regard to backspin generation. In addition, such preferable performance results are believed to achieve the particular synergistic result of such surface roughness attributes in combination with the mass attributes (e.g. center of gravity location, and moment of inertia characteristics) described above with regard to the embodiment of FIG. 1.

Figure 37A:
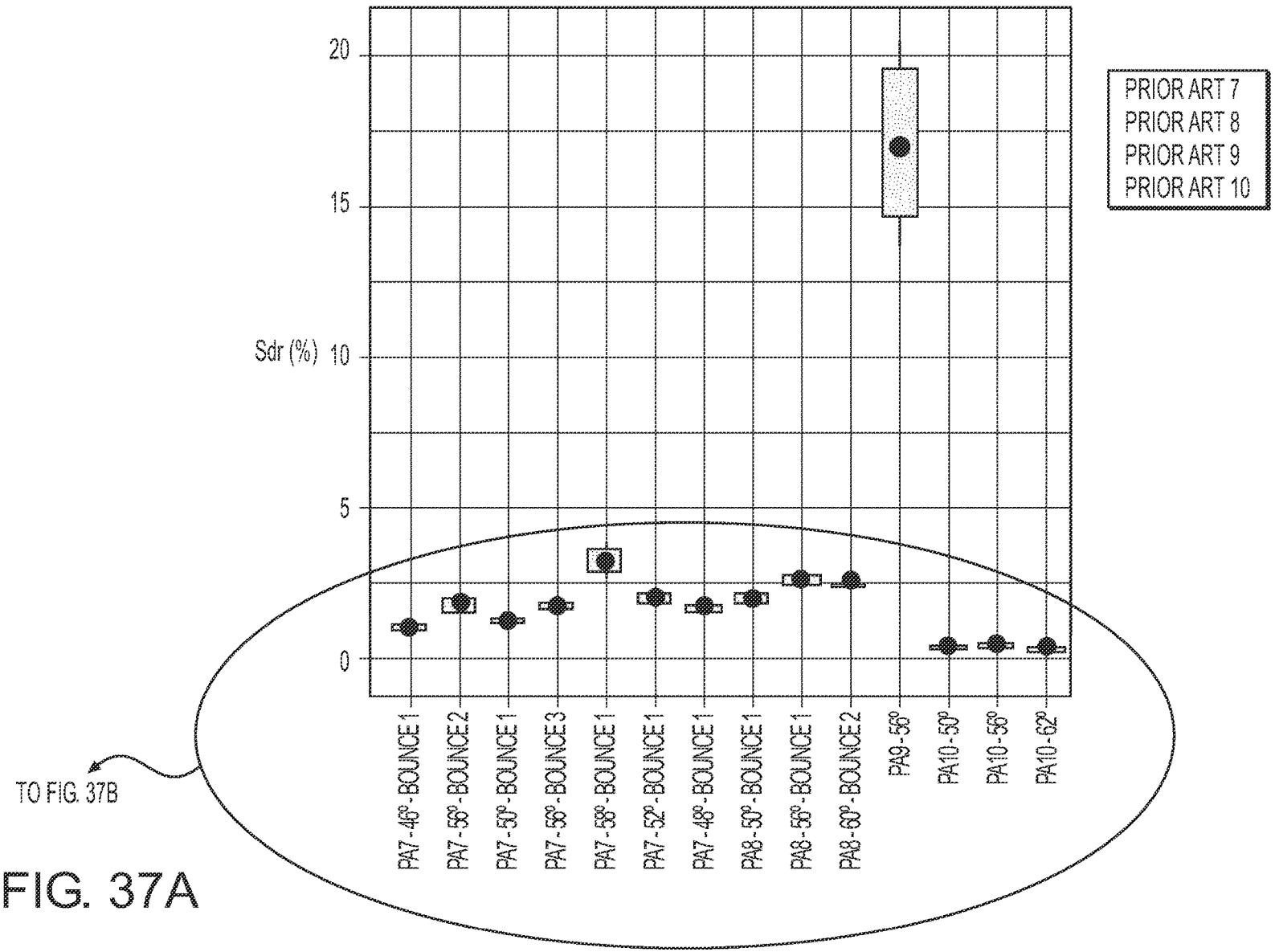
FIGS. 37A and 37B show plots of Sdr values for various golf club heads.
Figure 37B:
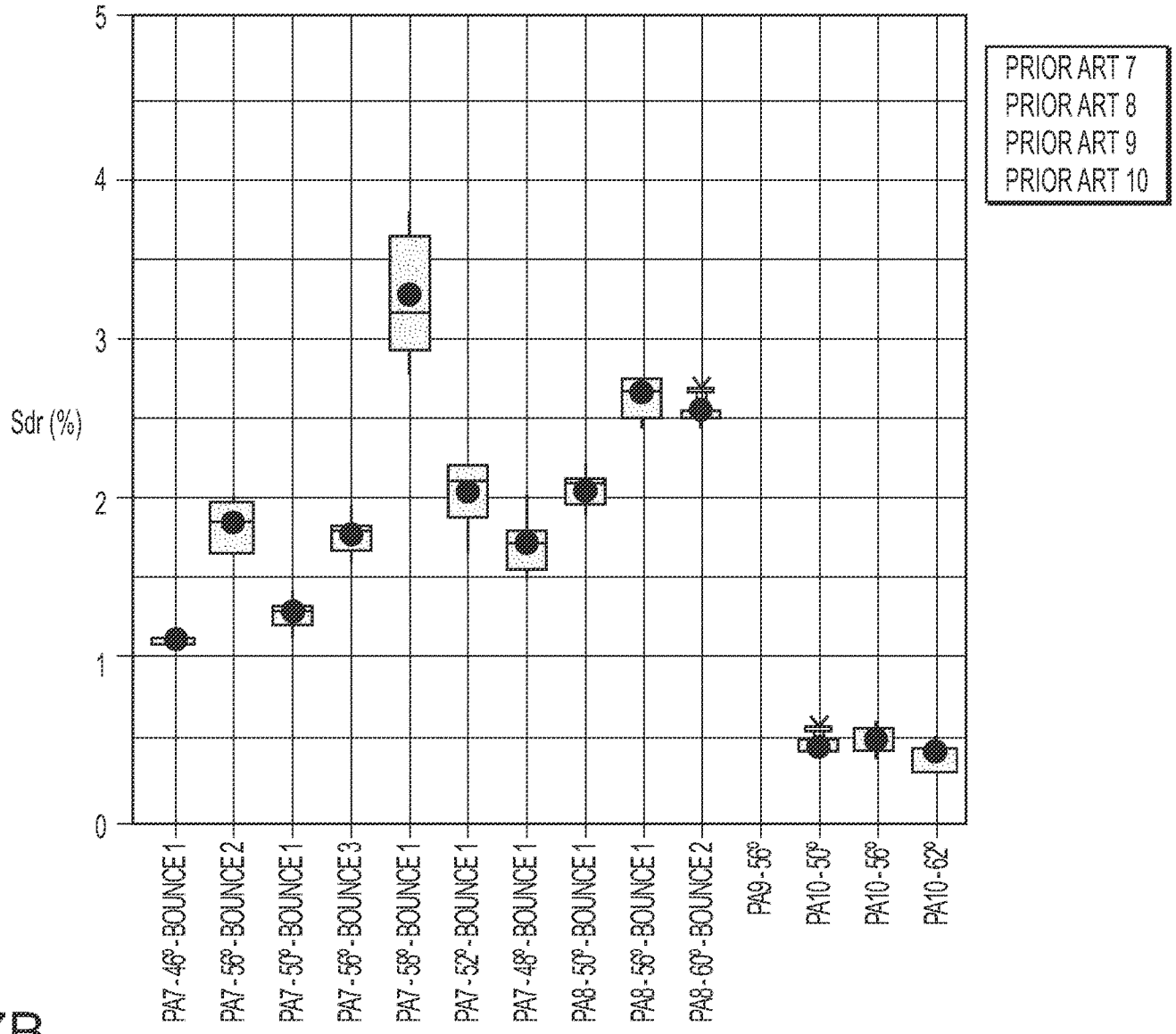

Additionally, or alternatively, Sdr varies as a function of loft, and therefore preferably varies within a correlated set or portfolio of golf club heads. For example, an absolute difference between Sdr values of differently-lofted club heads of a common set is preferably no less than 0.75%, more preferably no less than 1.0%. Such variations and values are further illustrated in the plots shown in FIGS. 37A and 37B. Preferably such variation occurs between a first club head having a loft in the range of 46°-52° and a second club head having a loft in the range of 56° to 64°.

Figure 38:
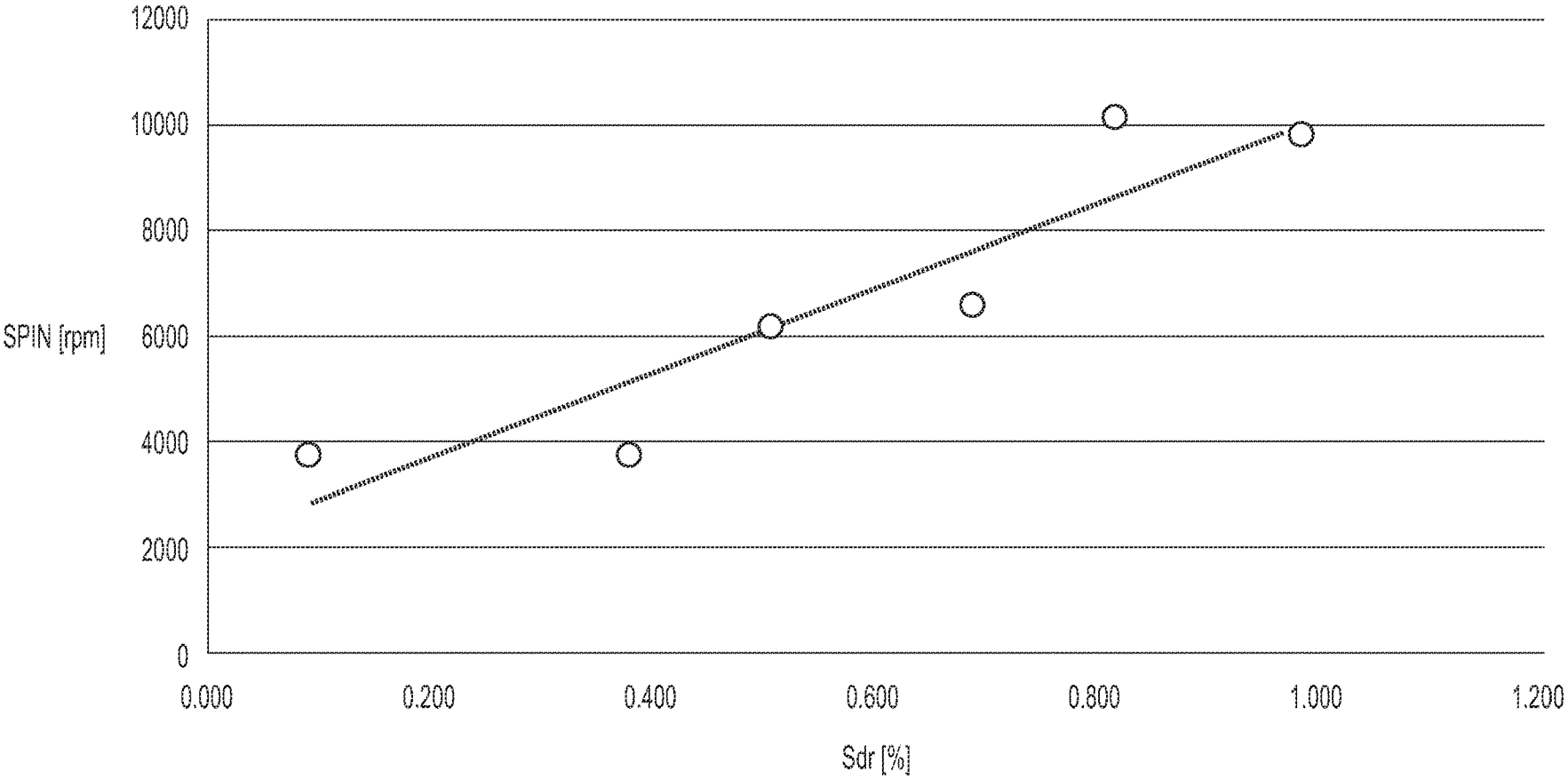
FIG. 38 shows $R^2$ modeling of exemplary golf club heads.

As may be the case with average surface roughness, Ra, and likely with many common surface roughness parameters, a single attribute is rarely purely indicative of a resulting phenomenon without further qualification. It is believed that Sdr is highly correlative with performance, as shown for example in the plot of FIG. 38 demonstrating $R^2$ modeling of exemplary club heads according to the present disclosure.

However, it is further believed that a surface in which high surface area is relatively uniformly dispersed is the primary factor corresponding to significant gains in spin performance. The complex dynamic interaction described above is believed to play on, in part, moisture's cohesive properties, surface tension properties, and absorbance properties of the substrate material. In other words, surfaces that inadvertently bear high Sdr, but in a non-uniform manner, may not produce the beneficial results achieved herein. A helpful means for quantifying this distinction, from a practical point of view, as an example, lies in yet another common metrological parameter, "reduced peak height to core ratio," or Spk/Sk.

Figure 39A:
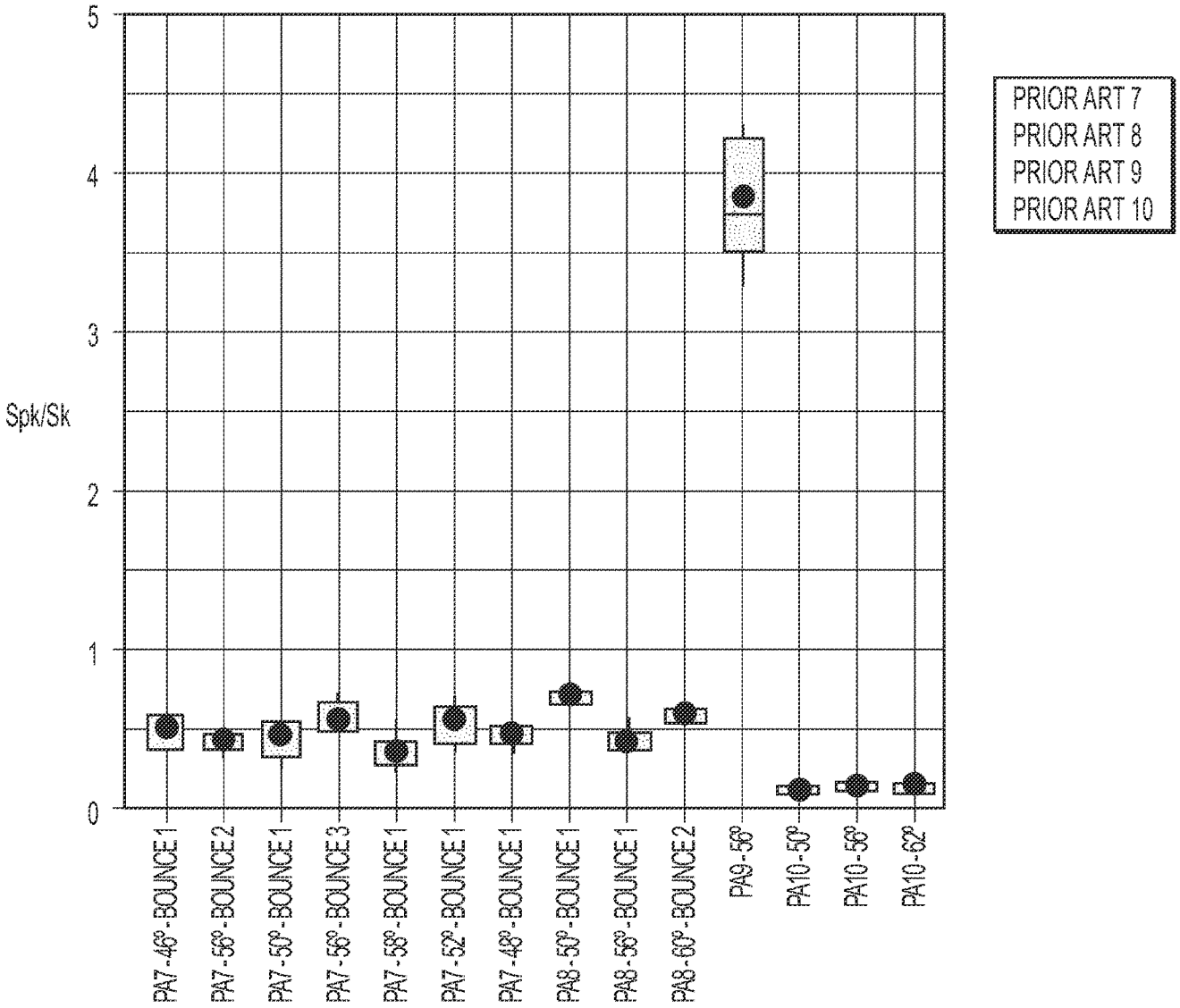
FIGS. 39A and 39B show plots of Spk/Sk and Svk/Sk, respectively, for various golf club heads.
Figure 39B:
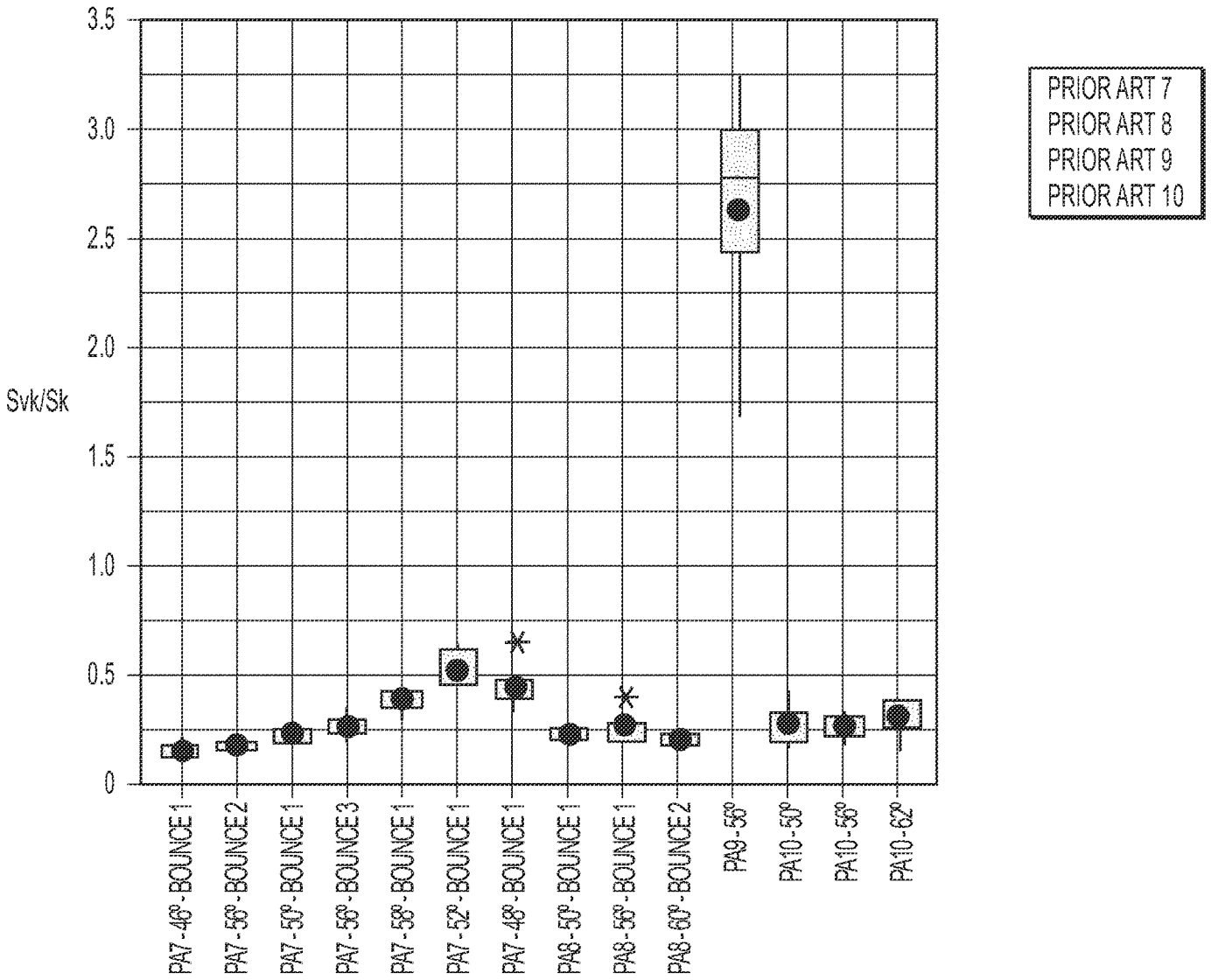

In addition, or alternatively, to the above, the striking face of the club head of the above embodiments preferably bears an Spk/Sk no greater than 2, more preferably no greater than 1, as shown in the plots of FIGS. 39A and 39B.

Additionally, or alternatively, regarding embodiments pertaining to portfolios of club heads, preferably such portfolio includes wedge-type club heads that vary in characteristics apart from loft. For example, a portfolio of club heads preferably includes varying bounce offerings, for example, a low bounce option, a mid-bounce option and a full bounce option. In such cases, in conjunction with varying sole grind features, a leading edge radius varies in each case of low bounce, mid-bounce and full bounce. Specifically, preferably, leading edge radius increases from low bounce to mid-bounce and from mid-bounce to full bounce. In FIGS. 20-24, another club head embodiment is shown. The golf club head 600 of FIGS. 20-24 preferably includes all features and characteristics described above with regard to the embodiment of FIG. 1, but it differs in exterior contour and appearance. For example this club head 600 preferably includes a pronounced mass feature 612, e.g. a triangular mass feature located in the upper toe region 610 of the club head rearward of the striking face 660. Further, preferably, first 614 and second 616 stiffening elements are located on the rear surface 682 of the striking face. Such elements further facilitate ensuring the structural integrity of the club head, while increasing discretionary mass for achieving the latent properties described above with regard to the embodiment of FIG. 1.

In FIGS. 25-29, another club head embodiment is shown. The golf club head 700 of FIGS. 25-29 preferably includes all features and characteristics described above with regard to the embodiment of FIG. 1, but it differs in exterior contour and appearance. For example this club head 700 preferably includes a pronounced mass feature 712, e.g. a triangular mass feature located in the upper toe region 710 of the club head rearward of the striking face 760. Further, preferably, with specific regard to FIG. 29, a medallion 714 is secured to the rear surface 782 of the striking face, and an insert 716, preferably in the form of a cover, is associated with a top surface of a lower portion, e.g. a muscle portion, of the rear portion 780 of the club head. The golf club head 700 generally takes the form of a blade-like wedge-type golf club head. However, this club may specifically comprise a "game improvement" style wedge-type club head, e.g. having hybrid features that adapt the club head to higher handicap level golfers. For example, the muscle portion may include recesses having therewithin mass features and/or aft-provided mass inserts, preferably having a density greater than the density of the main body. For example, such inserts may have a density no less than 8 g/cc, more preferably, no less than 10 g/cc. For continuity, the recesses, one of which is preferably located proximate the heel portion 720 of the club head and the other preferably located proximate the toe portion 710 of the club head, are covered by the cover described above. The cover may be mechanically secured to the lower, muscle portion of the rear portion 780 of the club head, e.g. by fasteners and/or interlocking fit such as press-fit. Alternatively, or in addition, chemical adhesive may be applied to bond the cover to such rear portion of the club head. Further, in some embodiments, with particular reference to FIG. 28, the striking face 760 of the club head may include a plurality of scorelines 762 that extend substantially across the entirety of the striking face. Such enables the golfer greater flexibility in shot selection as well as greater forgiveness in the case of higher-handicap golfers. Such a feature also benefits from the latent mass properties applied to the golf club head as described above with regard to the embodiment of FIG. 1. Such elements further facilitate ensuring the structural integrity of the club head, while increasing discretionary mass for achieving the latent properties described above with regard to the embodiment of FIG. 1.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

I claim:

1. A correlated set of golf club heads comprising:

a first golf club head comprising a first loft and a first striking face comprising a first base surface, including a first base surface portion, and a first plurality of scorelines recessed from the first base surface, the first base surface portion having a first average surface roughness, Ra1, no greater than 180 μin, a first reduced peak height to core ratio, Spk/Sk1, no greater than 2, and a first developed interfacial area ratio, Sdr1, no less than 1%; and a second golf club head comprising a second loft different from the first loft and a second striking face comprising a second base surface, including a second base surface portion, and a second plurality of scorelines recessed from the second base surface, the second base surface portion having a second average surface roughness, Ra2, no greater than 180 μin, a second reduced peak height to core ratio, Spk/Sk2, no greater than 2, and a second developed interfacial area ratio, Sdr2, such that a difference between Sdr2 and Sdr1 is no less than 0.75%.

2. The correlated set of golf club heads of claim 1, wherein the difference between Sdr2 and Sdr1 is no less than 1.0%.

3. The golf club head of claim 1, wherein at least one of the first base surface portion and the second base surface portion further comprises an Ra of between about 120 μin and 180 μin.

4. The golf club head of claim 1, wherein both the first loft and the second loft are no less than 39°.

5. The golf club head of claim 1, wherein at least one of the first base surface portion and the second base surface portion further comprises an Rz no greater than 1000.

6. The golf club head of claim 1, further comprising a wedge-type golf club head.

7. The golf club head of claim 1, wherein each of the first golf club head and the second golf club head further comprise:

a center of gravity;

a moment of inertia, Iyy, measured about an axis parallel with the virtual ground plane, extending in a heel to toe direction, and passing through the center of gravity, Iyy being no less than 1000 $g \cdot cm^2$.

* * * * *